US009152069B2

(12) United States Patent
Watanabe et al.

(10) Patent No.: US 9,152,069 B2
(45) Date of Patent: Oct. 6, 2015

(54) TONER, AND FULL-COLOR IMAGE FORMING METHOD AND FULL-COLOR IMAGE FORMING APPARATUS USING THE TONER

(75) Inventors: Masaki Watanabe, Shizuoka (JP); Hiroshi Yamashita, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/001,763

(22) PCT Filed: Feb. 17, 2012

(86) PCT No.: PCT/JP2012/054490

§ 371 (c)(1),
(2), (4) Date: Aug. 27, 2013

(87) PCT Pub. No.: WO2012/117952

PCT Pub. Date: Sep. 7, 2012

(65) Prior Publication Data

US 2013/0337376 A1 Dec. 19, 2013

(30) Foreign Application Priority Data

Feb. 28, 2011 (JP) ..... 2011-041288

(51) Int. Cl.
*G03G 9/087* (2006.01)
*G03G 9/16* (2006.01)
*G03G 9/097* (2006.01)

(52) U.S. Cl.
CPC ..... *G03G 9/16* (2013.01); *G03G 9/08748* (2013.01); *G03G 9/09733* (2013.01)

(58) Field of Classification Search
CPC ..... G03G 9/08797; G03G 9/08755; G03G 9/0819; G03G 9/08795; G03G 9/0827; G03G 9/0821; G03G 9/09708
USPC ..... 430/108.1, 109.4, 110.3, 110.4
See application file for complete search history.

(56) References Cited

U.S. PATENT DOCUMENTS 3,448,078 A * 6/1969 Higginbottom ..... 528/138
4,206,064 A 6/1980 Kiuchi et al.

(Continued)

FOREIGN PATENT DOCUMENTS

EP 0242420 A1 10/1987
JP 55-042752 11/1980

(Continued)

OTHER PUBLICATIONS

International Search Report Issued May 15, 2012 for counterpart International Patent Application No. PCT/JP2012/054490 Filed Feb. 17, 2012.

(Continued)

*Primary Examiner* — Hoa V Le
(74) *Attorney, Agent, or Firm* — Oblon, McClelland, Maier & Neustadt, L.L.P.

(57) ABSTRACT

A toner including a binder resin, a colorant and a phenol multimer represented by the following General Formula (1): where $R^1$ to $R^6$, $R^{11}$, $R^{12}$, $R^{14}$ to $R^{16}$, $R^{21}$, $R^{22}$, and $R^{24}$ to $R^{26}$ each are a hydrogen atom or a substituent; and n is an integer.

(1)

12 Claims, 6 Drawing Sheets

(56) References Cited

U.S. PATENT DOCUMENTS

| | | | | |
|---|---|---|---|---|
| 4,403,027 | A | 9/1983 | Ishikawa et al. | |
| 4,656,112 | A | 4/1987 | Kawagishi et al. | |
| 5,049,467 | A * | 9/1991 | Yamanaka | 430/108.1 |
| 5,346,797 | A | 9/1994 | Kmiecik-Lawrynowicz et al. | |
| 5,972,554 | A * | 10/1999 | Nagatsuka et al. | 430/108.1 |
| 5,976,749 | A | 11/1999 | Sukata et al. | |
| 6,936,390 | B2 | 8/2005 | Nanya et al. | |
| 2003/0138717 | A1* | 7/2003 | Yagi et al. | 430/110.4 |
| 2009/0123186 | A1 | 5/2009 | Sugiura et al. | |
| 2009/0142682 | A1* | 6/2009 | Saitoh et al. | 430/108.2 |
| 2011/0151372 | A1* | 6/2011 | Watanabe et al. | 430/119.86 |

FOREIGN PATENT DOCUMENTS

| | | | |
|---|---|---|---|
| JP | 57-111541 | | 7/1982 |
| JP | 61-069073 | | 4/1986 |
| JP | 61-221756 | | 10/1986 |
| JP | 62-094856 | | 5/1987 |
| JP | 03-237467 | | 10/1991 |
| JP | 04-139456 | | 5/1992 |
| JP | 06-250439 | | 9/1994 |
| JP | 07-031421 | | 4/1995 |
| JP | 07-104620 | | 11/1995 |
| JP | 2568675 | | 1/1997 |
| JP | 09-124659 | | 5/1997 |
| JP | 11-015205 | | 1/1999 |
| JP | 2003-280269 | | 10/2003 |
| JP | 3640918 | | 1/2005 |
| JP | 2007-127776 | | 5/2007 |
| RU | 2 100 836 | C1 | 12/1997 |
| RU | 2 386 158 | C1 | 4/2010 |
| RU | 2 397 525 | C2 | 8/2010 |

OTHER PUBLICATIONS

Official Decision of Grant issued Mar. 23, 2015 in Russian Patent Application No. 2013143826, filed Feb. 17, 2012 w/attached English translation.

* cited by examiner

TONER, AND FULL-COLOR IMAGE FORMING METHOD AND FULL-COLOR IMAGE FORMING APPARATUS USING THE TONER

TECHNICAL FIELD

The present invention relates to a toner, and a full-color image forming method and a full-color image forming apparatus using the toner.

BACKGROUND ART

In recent years, in the field of an image forming technology based on electrophotography, increased demand has arisen for full-color image formation capable of providing images with higher image quality, and thus, developers have been designed so as to provide high-quality images. In order to cope with the demand for the improved image quality, particularly in full-color images, there is an increasing tendency toward the production of toners having smaller particle diameters, and studies have been made on faithful reproduction of latent images. Regarding the reduction in particle diameter, a process for producing a toner by a polymerization process has been proposed as a method that can regulate the toner so as to have desired shape and surface structure (see, for example, PTLs 1 and 2). In the toner produced by the polymerization process, in addition to the control of the diameter of toner particles, the shape of toner particles can also be controlled. A combination of this technique with a particle size reduction can improve the reproducibility of dots and thin lines, and can reduce pile height (image layer thickness), whereby an improvement in image quality can be expected. The polymerized toner generally contains a binder resin, a colorant, a charge-controlling agent and other additives.

Conventionally, various charge-controlling agents have been proposed to impart to toners excellent charging property, stability over time and environmental stability. In this case, since a colored material cannot be used in a charge-controlling agent for use in full-color toners, there must be used colorless, white or light-colored charge-controlling agents which do not affect the hue of the toner.

Examples of such charge-controlling agents proposed include metal complex salts of salicylic acid derivatives (see PTLs 3 to 6), metal salts of aromatic dicarboxylic acids (see PTL 7), metal complex salts of anthranilic acid derivatives (see PTL 8) and organic boron compounds (see PTLs 9 and 10).

However, these charge-controlling agents have disadvantages that they contain chromium which may be unstable to the environment, and have insufficient durability, charge-imparting effects and environmental stability. Thus, they do not have sufficient performance to be used successfully as a charge-controlling agent. Also, as a metal-free charge-controlling agent, condensates of phenol derivatives have been proposed (see PTL 11). These condensates may satisfactorily meet the requirements of a charge-controlling agent.

As described above, in the polymerized toner, the charge-controlling agent derived from the toner material may be decomposed, or difficult to disperse in the toner. In many cases, the charge-controlling agent cannot sufficiently exhibit its functions, which is problematic. Therefore, there have been no toners excellent in chargeability, durability and environmental stability by using a charge controlling agent applicable to a polymerized toner, having smaller particle diameter and forming high-quality images. In addition, the relevant techniques to the formation of such toners have not yet been provided. Therefore, keen demand has arisen for such toners and techniques.

CITATION LIST

Patent Literature

PTL 1: Japanese Patent (JP-B) No. 3640918
PTL 2: Japanese Patent Application Laid-Open (JP-A) No. 06-250439
PTL 3: Japanese Patent Application Publication (JP-B) No. 55-42752
PTL 4: JP-A No. 61-69073
PTL 5: JP-A No. 61-221756
PTL 6: JP-A No. 09-124659
PTL 7: JP-A No. 57-111541
PTL 8: JP-A No. 62-94856
PTL 9: JP-B No. 07-31421
PTL 10: JP-B No. 07-104620
PTL 11: JP-B No. 2568675

SUMMARY OF INVENTION

Technical Problem

The present invention aims to provide: a toner for use in a full-color image forming method, which is excellent in chargeability, charge rising property, durability and environmental stability by using a charge controlling agent applicable to a polymerized toner; and a full-color image forming method and a full-color image forming apparatus each using this toner.

Solution to Problem

Means for solving the above problems are as follows.

Specifically, a toner of the present invention includes:

a binder resin;

a colorant; and a phenol multimer represented by the following General Formula (1):

(1)

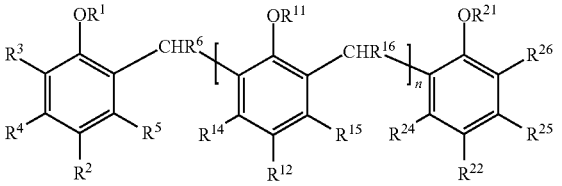

where $R^1$ represents a hydrogen atom, a C1-C5 alkyl group or —$(CH_2)_m COOR^{10}$, where $R^{10}$ represents a hydrogen atom or a C1-C10 alkyl group and m is an integer of 1 to 3; $R^2$ represents a hydrogen atom, a halogen atom, a C1-C12 alkyl group which may be branched, an aralkyl group, —$NO_2$, —$NH_2$, —$SO_3H$, a phenyl group which may have a substituent, an alkoxy group, —$Si(CH_3)_3$ or —$NR^7{}_2$ where $R^7$ represents a C1-C10 alkyl group; $R^3$ to $R^5$ each represent a hydrogen atom, a halogen atom, a C1-C3 alkyl group, —$NH_2$ or —$N(R^9)_2$ where $R^9$ represents a C1-C10 alkyl group; $R^6$ represents a hydrogen atom or a C1-C3 alkyl group; $R^{11}$ represents a hydrogen atom, a C1-C5 alkyl group or —$(CH_2)_p COOR^{20}$, where $R^{20}$ represents a hydrogen atom or a C1-C10 alkyl group and p is an integer of 1 to 3; $R^{12}$ represents a hydrogen atom, a halogen atom, a C1-C12 alkyl group which may be branched, an aralkyl group, —$NO_2$, —$NH_2$, —$N(R^{17})_2$, where $R^{17}$ represents a C1-C10 alkyl group, —$SO_3H$, a phenyl group which may have a substituent, an alkoxy group or —$Si(CH_3)_3$, $R^{14}$ and $R^{15}$ each represent a hydrogen atom, a halogen atom, a C1-C3 alkyl group, —$NH_2$ or —$N(R^{19})_2$ where $R^{19}$ represents a C1-C10 alkyl group; $R^{16}$ represents a hydrogen atom or a C1-C3 alkyl group; $R^{21}$ represents a hydrogen atom, a C1-C5 alkyl group or —$(CH_2)_q$ $COOR^{20}$ where $R^{20}$ represents a hydrogen atom or a C1-C10 alkyl group and q is an integer of 1 to 3; $R^{22}$ represents a hydrogen atom, a halogen atom, a C1-C12 alkyl group which may be branched, an aralkyl group, —$NO_2$, —$NH_2$ or —$N(R^{17})_2$ where $R^{17}$ represents a C1-C10 alkyl group, —$SO_3H$, a phenyl group which may have a substituent, an alkoxy group or —$Si(CH_3)_3$; $R^{24}$ and $R^{25}$ each represent a hydrogen atom, a halogen atom, a C1-C3 alkyl group, —$NH_2$ or —$N(R^{19})_2$, where $R^{19}$ represents a C1-C10 alkyl group; $R^{26}$ represents a hydrogen atom or a C1-C3 alkyl group; n denotes a polymerization degree which is an integer.

Advantageous Effects of Invention

The present invention can provide: a toner excellent in chargeability, charge rising property, durability and environmental stability; and full-color image forming method and apparatus each using this toner.

DESCRIPTION OF EMBODIMENTS (Toner)

Figure 1:
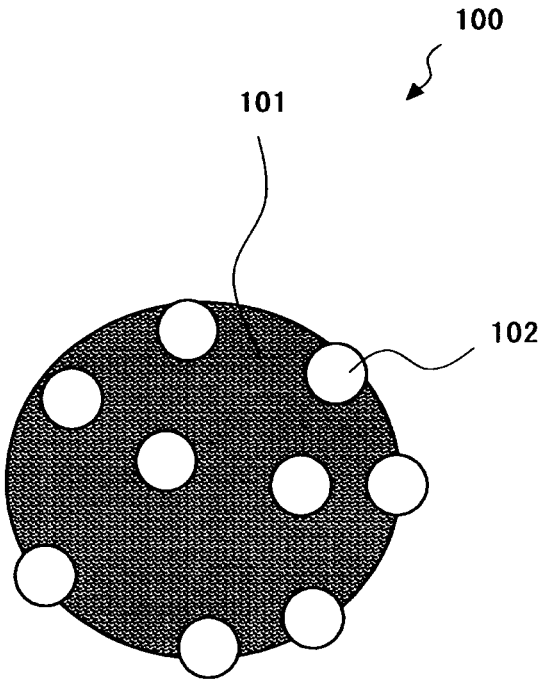
FIG. 1 illustrates one exemplary structure of a toner of the present invention.

A toner of the present invention contains a binder resin, a colorant, and the below-described phenol multimer represented by General Formula (1); and, if necessary, further contains other ingredients.

The toner is preferably produced by a toner production method including a solution or dispersion liquid-preparing step, an emulsion or dispersion liquid-preparing step and an organic solvent-removing step.

<Solution or Dispersion Liquid-preparing Step>

The solution or dispersion liquid-preparing step is a step of dissolving or dispersing in an organic solvent a toner material containing at least a binder resin or a binder resin precursor and the below-described phenol multimer represented by General Formula (1), to thereby prepare a solution or dispersion liquid of the toner material.

Examples of the binder resin precursor include a polymer (prepolymer) reactive with an active hydrogen group-containing compound. When the binder resin precursor is used instead of the binder resin, the binder resin precursor is reacted with the active hydrogen group-containing compound in the emulsion or dispersion liquid-preparing step to obtain a binder resin derived from the binder resin precursor.

The toner material is not particularly limited, so long as it contains the binder resin or binder resin precursor and the phenol multimer, and may be appropriately selected depending on the intended purpose.

For example, the toner material contains a colorant; and, if necessary, may further contain other ingredients such as a releasing agent and a charge-controlling agent.

Notably, the organic solvent is removed in the organic solvent-removing step after or during formation of toner particles in the emulsion or dispersion liquid-preparing step.

—Organic Solvent—

The organic solvent is not particularly limited, so long as it allows the toner material to be dissolved or dispersed therein, and may be appropriately selected depending on the intended purpose. It is preferable that the organic solvent be a solvent having a boiling point of lower than 150° C. in terms of easy removal during or after formation of toner particles. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These organic solvents may be used alone or in combination. Among these organic solvents, ester solvents are preferable, with ethyl acetate being more preferable.

The amount of the organic solvent is not particularly limited and may be appropriately selected depending on the intended purpose. Preferably, the amount of the organic solvent is 40 parts by mass to 300 parts by mass, more preferably 60 parts by mass to 140 parts by mass, particularly preferably 80 parts by mass to 120 parts by mass, per 100 parts by mass of the toner material.

The solution or dispersion liquid of the toner material can be prepared by dissolving or dispersing in the organic solvent the toner materials such as the binder resin, the active hydrogen group-containing compound, the polymer reactive with the active hydrogen group-containing compound, the releasing agent, the colorant and the charge controlling agent.

The toner materials used in the solution or dispersion liquid-preparing step may contain at least the binder resin or binder resin precursor. The other materials may be added to and mixed with the aqueous medium in the emulsion or dispersion liquid-preparing step, or may be added to the aqueous medium at the same time as the solution or dispersion liquid of the toner materials.

—Phenol Multimer—

The phenol multimer is internally added so as to exist inside each toner particle, so that it is localized in the vicinity of the toner surface without being decomposed by the toner material. It is used for the purpose of imparting charging properties to the toner. Use of the phenol multimer is preferable since the formed toner has high chargeability. The phenol multimer is a compound represented by the following General Formula (1):

(1)

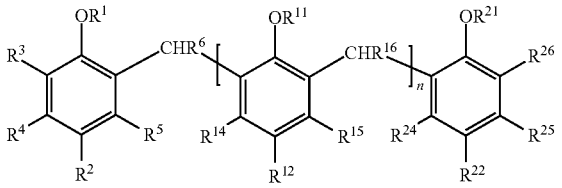

where $R^1$ represents a hydrogen atom, a C1-C5 alkyl group or —$(CH_2)_m COOR^{10}$, where $R^{10}$ represents a hydrogen atom or a C1-C10 alkyl group and m is an integer of 1 to 3; $R^2$ represents a hydrogen atom, a halogen atom, a C1-C12 alkyl group which may be branched, an aralkyl group, —$NO_2$, —$NH_2$, —$SO_3H$, a phenyl group which may have a substituent, an alkoxy group, —$Si(CH_3)_3$ or —$NR^7{}_2$ where $R^7$ represents a C1-C10 alkyl group; $R^3$ to $R^5$ each represent a hydrogen atom, a halogen atom, a C1-C3 alkyl group, —$NH_2$ or —$N(R^9)_2$ where $R^9$ represents a C1-C10 alkyl group; $R^6$ represents a hydrogen atom or a C1-C3 alkyl group; $R^{11}$ represents a hydrogen atom, a C1-C5 alkyl group or —$(CH_2)_p COOR^{20}$ where $R^{20}$ represents a hydrogen atom or a C1-C10 alkyl group and p is an integer of 1 to 3; $R^{12}$ represents a hydrogen atom, a halogen atom, a C1-C12 alkyl group which may be branched, an aralkyl group, —$NO_2$, —$NH_2$, —$N(R^{17})_2$, where $R^{17}$ represents a C1-C10 alkyl group, —$SO_3H$, a phenyl group which may have a substituent, an alkoxy group or —$Si(CH_3)_3$, $R^{14}$ and $R^{15}$ each represent a hydrogen atom, a halogen atom, a C1-C3 alkyl group, —$NH_2$ or —$N(R^{19})_2$ where $R^{19}$ represents a C1-C10 alkyl group; $R^{16}$ represents a hydrogen atom or a C1-C3 alkyl group; $R^{21}$ represents a hydrogen atom, a C1-C5 alkyl group or —$(CH_2)_q COOR^{20}$ where $R^{20}$ represents a hydrogen atom or a C1-C10 alkyl group and q is an integer of 1 to 3; $R^{22}$ represents a hydrogen atom, a halogen atom, a C1-C12 alkyl group which may be branched, an aralkyl group, —$NO_2$, —$NH_2$ or —$N(R^{17})_2$, where $R^{17}$ represents a C1-C10 alkyl group, —$SO_3H$, a phenyl group which may have a substituent, an alkoxy group or —$Si(CH_3)_3$; $R^{24}$ and $R^{25}$ each represent a hydrogen atom, a halogen atom, a C1-C3 alkyl group, —$NH_2$ or —$N(R^{19})_2$, where $R^{19}$ represents a C1-C10 alkyl group; $R^{26}$ represents a hydrogen atom or a C1-C3 alkyl group; n denotes a polymerization degree which is an integer.

Examples of the C1-C12 alkyl group which may be branched include methyl, ethyl, propyl, iropropyl, butyl, isobutyl, sec-butyl, tert-butyl, pentyl, hexyl, heptyl and octyl. The number of carbon atoms contained in the alkyl group is preferably 1 to 10, more preferably 1 to 6. The C1-C5 alkyl group and the C1-C3 alkyl group are respectively C1-C5 alkyl groups and C1-C3 alkyl groups of the above-listed alkyl groups.

Examples of the aralkyl group include benzyl, phenethyl, naphthylmethyl and naphthylethyl. Examples of the alkoxy group include methoxy, ethoxy, propoxy, isopropoxy, butoxy, isobutoxy, sec-butoxy and tert-butoxy. Examples of the halogen atom include fluorine, chlorine, bromine and iodine. The phenyl group may be a substituted phenyl group such as a p-chlorophenyl group or a p-bromophenyl group.

In General Formula (1), $R^1$ and other variables can be selected from the above listed groups and atoms but are preferably the following groups and atoms. $R^1$ is preferably a hydrogen atom. $R^2$ is preferably a halogen atom. $R^3$ is preferably a hydrogen atom. $R^4$ is preferably a hydrogen atom or a methyl group. $R^5$ is preferably a hydrogen atom or a methyl group. $R^6$ is preferably a hydrogen atom. $R^{11}$ is preferably a hydrogen atom. $R^{12}$ is preferably a halogen atom. $R^{14}$ is preferably a hydrogen atom or a methyl group. $R^{15}$ is a hydrogen atom or a methyl group. $R^{16}$ is preferably a hydrogen atom. $R^{21}$ is preferably a hydrogen atom. $R^{22}$ is preferably a halogen atom. $R^{24}$ is preferably a hydrogen atom or a methyl group. $R^{25}$ is preferably a hydrogen atom or a methyl group. $R^{26}$ is preferably a hydrogen atom.

In particularly preferred embodiment of the phenol multimer represented by General Formula (1), $R^1$ is preferably a hydrogen atom, $R^2$ is preferably a chlorine atom, $R^3$ is preferably a hydrogen atom, $R^4$ is preferably a hydrogen atom, $R^5$ is preferably a hydrogen atom, $R^6$ is preferably a hydrogen atom, $R^{11}$ is preferably a hydrogen atom, $R^{12}$ is preferably a chlorine atom, $R^{14}$ is preferably a hydrogen atom, $R^{15}$ is preferably a hydrogen atom, $R^{16}$ is preferably a hydrogen atom, $R^{21}$ is preferably a hydrogen atom, $R^{22}$ is preferably a chlorine atom, $R^{24}$ is preferably a hydrogen atom, $R^{25}$ is preferably a hydrogen atom, and $R^{26}$ is preferably a hydrogen atom. This is because when $R^4$, $R^5$, $R^{14}$, $R^{15}$, $R^{24}$ and $R^{25}$ each are a methyl group, the phenol multimer is degraded in electron attracting property, leading to a drop in charge-imparting effects. Also, when fluorine atoms are used instead of the above chlorine atoms, the phenol multimer exhibits solubility to ethyl acetate. When bromine atoms are used instead of the above chlorine atoms, the phenol multimer cannot be crystallized. Thus, chlorine atoms are particularly preferred.

The polymerization degree n of the phenol multimer is an integer of 1 or greater, preferably 5 to 25, more preferably 10 to 20. When the polymerization degree is lower, the phenol multimer has increased solubility to ethyl acetate. As a result, when internally added to the toner, it uniformly diffuses in the toner or oozes out the toner. Thus, the phenol multimer cannot satisfactorily exhibit its intrinsic functions in some cases.

The phenol multimer can be incorporated as desired into a resin phase of the toner particles by utilizing the difference in affinity to the resins of the toner particles each containing the toner material as a nucleus. By incorporating the phenol multimer into the resin phase in the vicinity of the surfaces of the toner particles, the spent of the charge controlling agent to other members such as a photoconductor and a carrier can be suppressed.

The average dispersion diameter of the phenol multimer contained in the solution or dispersion liquid prepared in the solution or dispersion liquid-preparing step is not particularly limited and may be appropriately selected depending on the intended purpose. The average dispersion diameter thereof is preferably 10 nm to 500 nm, more preferably 100 nm to 500 nm, particularly preferably 100 nm to 150 nm. When the average dispersion diameter thereof is smaller than 10 nm, the phenol multimer is localized in the toner surface in a large amount, and the formed toner is considerably deformed. The charge amount more than required may be obtained, and charge-imparting effects cannot be obtained satisfactorily in some cases. When the average dispersion diameter is larger than 500 nm, the phenol multimer is transferred from the toner to the carrier upon stirring of them, potentially staining the carrier to decrease the charge amount.

The average dispersion diameter of the phenol multimer can be measured, for example, as follows. Specifically, the toner (1 g) is immersed in chloroform (100 g) for 10 hours, and the phenol multimer dispersion liquid is centrifuged at 500 rpm (9,545 g) with a centrifuge (H-9R, product of KOKUSAN CO., LTD., using an LN angle rotor). The supernatant obtained after centrifugation contains particles of the phenol multimer, which are measured for particle diameter with a particle size distribution analyzer (LA-920, product of Horiba, Ltd.). In the measurement using LA-920, LA-920 specialized application (Ver 3.32) (product of Horiba, Ltd.) is used for analysis.

More specifically, the optical axis is adjusted with chloroform and then background is measured. Thereafter, circulation is initiated and the phenol multimer dispersion liquid is dropped. After it has been confirmed that the transmittance is stable, ultrasonic wave is applied under the following conditions. After application of ultrasonic wave, the diameter of particles dispersed is measured so that the transmittance falls within a range of 70% to 95%.

In terms of reproducibility in measuring the particle diameter, it is important that the measurement with LA-920 is performed under the conditions that the transmittance falls within a range of 70% to 95%. Also, when the transmittance deviates from the above range after the application of an ultrasonic wave, it is necessary to perform the measurement again. In order to render the transmittance to fall within the above range, the amount of the dispersion liquid dropped must be adjusted.

The measurement/analysis conditions are set as follows.

Number of inputs of data: 15 times

Relative refractive index: 1.20

Circulation: 5

Intensity of ultrasonic wave: 7

Notably, although the above measurement method measures the average dispersion diameter of the phenol multimer contained in the produced toner, the phenol multimer is internally added to the toner without being decomposed by the toner material and thus, the measurement can be used as an average dispersion diameter of the phenol multimer contained in the solution or dispersion liquid prepared in the solution or dispersion liquid-preparing step.

The state of the phenol multimer present in the toner can be observed as follows. Specifically, toner particles are stained for 3 min by being exposed to vapor of aqueous ruthenium oxide, and then left to stand in air for 30 min. Subsequently, the toner particles are wrapped with a curable epoxy resin for 30 min. Then, the obtained sample is cut with an ultramicrotome so as to have a thickness of 80 nm, and with a diamond knife (ULTRASONIC 35) at a cutting speed of 0.4 mm/sec. The thus-cut section is fixed on a collodion membrane mesh, and observed under a transmission electron microscope (JEM-2100F, product of JEOL Ltd., TEM) with the light-field method under the conditions: acceleration voltage: 200 kV, SpotSize3, CLAP1, OL AP3.

The amount of the phenol multimer added is not particularly limited and may be appropriately selected depending on the intended purpose. The amount of the phenol multimer is preferably 0.01% by mass to 5.0% by mass in the solution or dispersion liquid of the toner material. When the amount of the phenol multimer is less than 0.01% by mass, the toner cannot be effectively deformed in some cases. When the amount of the phenol multimer is more than 5.0% by mass, the chargeability of the toner becomes too large, which reduces the effect of a main charge controlling agent. As a result, the electrostatic attraction force to the developing roller used may be increased to cause degradation in flowability of the developer and degradation in image density. In addition, the surface conditions of the toner are degraded and contaminate carriers, not maintaining sufficient chargeability for a long period of time. Furthermore, the environmental stability is degraded in some cases.

—Binder Resin and Binder Resin Precursor—

The binder resin is not particularly limited and may be appropriately selected depending on the intended purpose. Specific examples thereof include polyester resins, silicone resins, styrene-acrylic resins, styrene resins, acrylic resins, epoxy resins, diene resins, phenol resins, terpene resins, coumarin resins, amide imide resins, butyral resins, urethane resins, and ethylene vinyl acetate resins. Among them, polyester resins are particularly preferable because of being sharply melted upon fixing, being capable of smoothing the image surface, having sufficient flexibility even if the molecular weight thereof is lowered. The polyester resins may be used in combination with another resin.

The polyester resins are preferably produced through reaction between one or more polyols represented by the following General Formula (2) and one or more polycarboxylic acids represented by the following General Formula (3):

$$A\text{-}(OH)r \qquad \text{General Formula (2)}$$

$$B\text{-}(COOH)s \qquad \text{General Formula (3)}$$

where A and B each represent an alkyl group having 1 to 20 carbon atoms, an alkylene group having 1 to 20 carbon atoms, an aromatic group which may have a substituent, or a heterocyclic aromatic group which may have a substituent; and r and s each are an integer of 2 to 4.

Examples of the polyol represented by General Formula (2) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A.

Examples of polycarboxylic acids represented by General Formula (3) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acid, cyclohexanedicarboxylic acid, cyclohexenedicarboxylic acid, butanetetracarboxylic acid, diphenylsulfonetetracarboxylic acid, and ethylene glycolbis(trimellitic acid).

The amount of the binder resin added is not particularly limited and may be appropriately selected depending on the intended purpose. The amount of the binder resin is preferably 5% by mass to 25% by mass in the solution or dispersion liquid of the above toner materials. When the amount of the binder resin is less than 5% by mass, the dispersion diameter of the phenol multimer cannot be small in some cases. When the amount of the binder resin is more than 25% by mass, the phenol multimers aggregate when added to the solution or dispersion liquid of the toner materials, resulting in that the deforming effects and charge-imparting effects cannot be satisfactorily obtained in some cases. The solution or dispersion liquid of the toner materials particularly preferably contains the phenol multimer in an amount of 5% by mass and the binder resin in an amount of 5% by mass.

(Active Hydrogen Group-containing Compound)

When the toner material contains an active hydrogen group-containing compound and a modified polyester resin reactive with the compound, the mechanical strength of the resultant toner is increased and embedding of external additives can be suppressed. Furthermore, the fluidity during the heat fixation can be regulated, and, consequently, the fixing temperature range can be broadened. Notably, in the present invention, the active hydrogen group-containing compound and the modified polyester resin reactive with the active hydrogen group-containing compound correspond to a binder resin precursor.

In the emulsion or dispersion liquid-preparing step, the active hydrogen group-containing compound serves, in the aqueous medium, as an elongating agent or a crosslinking agent for reactions of elongation or crosslinking of a polymer reactive with the active hydrogen group-containing compound. The active hydrogen group-containing compound is not particularly limited, so long as it contains an active hydrogen group, and may be appropriately selected depending on the intended purpose. For example, when the polymer reactive with the active hydrogen group-containing compound is an isocyanate group-containing polyester prepolymer (A), an amine (B) is preferably used as the active hydrogen group-containing compound, since it can provide a high-molecular-weight product through reactions of elongation or crosslinking with the isocyanate group-containing polyester prepolymer (A).

The active hydrogen group is not particularly limited and may be appropriately selected depending on the intended purpose. Examples thereof include a hydroxyl group (alcoholic or phenolic hydroxyl group), an amino group, a carboxylic group and a mercapto group. The active hydrogen group-containing compound may contain one or more types of these active hydrogen groups.

The amine (B) is not particularly limited and may be appropriately selected depending on the intended purpose. Examples thereof include diamines (B1), tri- or more-valent polyamines (B2), amino alcohols (B3), aminomercaptans (B4), amino acids (B5), and amino-blocked products (B6) of the amines (B1) to (B5). These may be used alone or in combination. Among them, preferred are diamines (B1) and a mixture of the diamines (B1) and a small amount of the tri- or more-valent amine (B2).

Examples of the diamine (B1) include aromatic diamines, alicyclic diamines and aliphatic diamines. Examples of the aromatic diamine include phenylenediamine, diethyltoluenediamine and 4,4'-diaminodiphenylmethane. Examples of the alicyclic diamine include 4,4'-diamino-3,3'-dimethyldicyclohexylmethane, diaminecyclohexane and isophoronediamine. Examples of the aliphatic diamines include ethylenediamine, tetramethylenediamine and hexamethylenediamine.

Examples of the tri- or more-valent amine (B2) include diethylenetriamine and triethylenetetramine. Examples of the amino alcohol (B3) include ethanolamine and hydroxyethylaniline. Examples of the aminomercaptan (B4) include aminoethyl mercaptan and aminopropyl mercaptan. Examples of the amino acid (B5) include aminopropionic acid and aminocaproic acid.

Examples of the amino-blocked product (B6) include ketimine compounds and oxazolidine compounds derived from the amines (B1) to (B5) and ketones (e.g., acetone, methyl ethyl ketone and methyl isobutyl ketone).

Also, a reaction terminator can be used for terminating elongation reaction or crosslinking reaction between the active hydrogen group-containing compound and the polymer reactive therewith. Use of the reaction terminator can control the adhesive base material in its molecular weight to a desired level. The reaction terminator is not particularly limited, and examples thereof include monoamines (e.g., diethyl amine, dibutyl amine, butyl amine and lauryl amine) and blocked products of the monoamines (e.g., ketimine compounds).

The mixing ratio of the isocyanate group-containing polyester prepolymer (A) to the amine (B) is not particularly limited but preferably 1/3 to 3/1, more preferably 1/2 to 2/1, particularly preferably 1/1.5 to 1.5/1, in terms of the equivalent ratio ([NCO]/[NHx]) of isocyanate group [NCO] in the isocyanate group-containing prepolymer (A) to amino group [NHx] in the amine (B).

When the equivalent ratio ([NCO]/[NHx]) is less than 1/3, the formed toner may have degraded low-temperature fixing property. When the equivalent ratio ([NCO]/[NHx]) is more than 3/1, the molecular weight of the urea-modified polyester resin decreases, resulting in that the formed toner may have degraded hot offset resistance.

—Polymer Reactive with Active Hydrogen Group-containing Compound—

The polymer reactive with the active hydrogen group-containing compound (hereinafter may be referred to as "prepolymer") is not particularly limited, so long as it has at least a site reactive with the active hydrogen group-containing compound, and may be appropriately selected from known resins. Examples thereof include polyol resins, polyacrylic resins, polyester resins, epoxy resins, and derivative resins thereof. Among them, polyester resins are preferred since they have high fluidity upon melting and high transparency. These may be used alone or in combination.

In the prepolymer, the reaction site reactive with the active hydrogen group-containing group is not particularly limited. Appropriately selected known substituents may be used as the reaction site. Examples thereof include an isocyanate group, an epoxy group, a carboxyl group and an acid chloride group, with an isocyanate group being preferred. The prepolymer may contain one or more types of these groups.

As the prepolymer, a urea bond-forming group-containing polyester resin (RMPE) containing a urea bond-forming group is preferred, since it is easily adjusted for the molecular weight of the polymeric component thereof and thus is preferably used for forming dry toner, in particular for assuring oil-less low temperature fixing property (e.g., releasing and fixing properties requiring no releasing oil-application mechanism for a heat-fixing medium).

Examples of the urea bond-forming group include an isocyanate group.

Preferred examples of the RMPE having an isocyanate group as the urea bond-forming group include the above isocyanate group-containing modified polyester prepolymer (A).

The isocyanate group-containing polyester prepolymer (A) is not particularly limited and may be appropriately selected depending on the intended purpose. Examples thereof include those produced as follows: a polyol (PO) is polycondensed with a polycarboxylic acid (PC) to form a polyester resin having an active hydrogen group; and the thus-formed polyester resin is reacted with a polyisocyanate (PIC).

The polyol (PO) is not particularly limited and may be appropriately selected depending on the intended purpose. Examples thereof include diols (DIOs), 3 or more hydroxyl group-containing polyols (TOs), and mixtures of diols (DIOs) and 3 or more hydroxyl group-containing polyols (TOs). These polyols may be used alone or in combination. Among them, preferred are diols (DIOs) and mixtures of diols (DIOs) and a small amount of 3 or more hydroxyl group-containing polyols (TOs).

Examples of the diol (DIO) include alkylene glycols, alkylene ether glycols, alicyclic diols, alkylene oxide adducts of alicyclic diols, bisphenols, and alkylene oxide adducts of bisphenols.

The alkylene glycol preferably is those containing an alkylene group having 2 to 12 carbon atoms, and examples thereof include ethylene glycol, 1,2-propylene glycol, 1,3-propylene glycol, 1,4-butanediol and 1,6-hexanediol.

Examples of the alkylene ether glycol include diethylene glycol, triethylene glycol, dipropylene glycol, polyethylene glycol, polypropylene glycol and polytetramethylene ether glycol.

Examples of the alicyclic diol include 1,4-cyclohexane dimethanol and hydrogenated bisphenol A.

Examples of the alkylene oxide adducts of alicyclic diols include adducts of alicyclic diols with alkylene oxides (e.g., ethylene oxide, propylene oxide and butylene oxide).

Examples of the bisphenol include bisphenol A, bisphenol F and bisphenol S.

Examples of the alkylene oxide adducts of bisphenols include adducts of bisphenols with alkylene oxides (e.g., ethylene oxide, propylene oxide and butylene oxide).

Among them, preferred are alkylene glycols containing an alkylene group having 2 to 12 carbon atoms and alkylene oxide adducts of bisphenols, more preferred are alkylene oxide adducts of bisphenols, and mixtures of alkylene glycols containing an alkylene group having 2 to 12 carbon atoms and alkylene oxide adducts of bisphenols.

The 3 or more hydroxyl group-containing polyol (TO) preferably has 3 to 8 or more hydroxyl groups. Examples thereof include 3 or more hydroxyl group-containing aliphatic polyhydric alcohols; and 3 or more hydroxyl group-containing polyphenols and alkylene oxide adducts thereof.

Examples of the 3 or more hydroxyl group-containing aliphatic polyhydric alcohol include glycerin, trimethylolethane, trimethylolpropane, pentaerythritol and sorbitol.

Examples of the 3 or more hydroxyl group-containing polyphenol include trisphenol compounds (e.g., trisphenol PA, product of HONSHU CHEMICAL INDUSTRY CO., LTD.), phenol novolak and cresol novolak.

Examples of the alkylene oxide adducts include adducts of the above-listed 3 or more hydroxyl group-containing polyphenols with alkylene oxides (e.g., ethylene oxide, propylene oxide and butylene oxide).

In the mixture of the diol (DIO) and the 3 or more hydroxyl group-containing polyol (TO), the mixing ratio by mass (DIO:TO) is preferably 100:0.01 to 100:10, more preferably 100:0.01 to 100:1.

The polycarboxylic acid (PC) is not particularly limited and may be appropriately selected depending on the intended purpose. Examples thereof include dicarboxylic acids (DICs), polycarboxylic acids having 3 or more carboxyl groups (TCs), and mixtures of dicarboxylic acids (DICs) and polycarboxylic acids having 3 or more carboxyl groups. These may be used alone or in combination. Among them, preferred are carboxylic acids (DICs) alone and mixtures of DICs and a small amount of polycarboxylic acids having 3 or more carboxyl groups (TCs).

Examples of the dicarboxylic acid (DIC) include alkylene dicarboxylic acids, alkenylene dicarboxylic acids, and aromatic dicarboxylic acids.

Examples of the alkylene dicarboxylic acid include succinic acid, adipic acid and sebacic acid.

The alkenylene dicarboxylic acid is preferably those having 4 to 20 carbon atoms, and examples thereof include maleic acid and fumaric acid. The aromatic dicarboxylic acid is preferably those having 8 to 20 carbon atoms, and examples thereof include phthalic acid, isophthalic acid, terephthalic acid, and naphthalenedicarboxylic acid.

Among them, preferred are alkenylene dicarboxylic acids having 4 to 20 carbon atoms and aromatic dicarboxylic acid having 8 to 20 carbon atoms.

The polycarboxylic acid having 3 or more carboxyl groups (TC) preferably has 3 to 8 or more carboxyl groups. Examples thereof include aromatic polycarboxylic acids.

The aromatic polycarboxylic acid is preferably those having 9 to 20 carbon atoms, and examples thereof include trimellitic acid and pyromellitic acid.

Alternatively, as the polycarboxylic acid (PC), there may be used acid anhydrides or lower alkyl esters of the above dicarboxylic acids (DICs), the above polycarboxylic acids having 3 or more carboxyl groups (TCs), and mixtures of the dicarboxylic acids (DICs) and the polycarboxylic acids having 3 or more carboxyl groups (TCs).

Examples of the lower alkyl esters thereof include methyl esters thereof, ethyl esters thereof and isopropyl esters thereof.

In the mixture of the dicarboxylic acid (DIC) and the polycarboxylic acid having 3 or more carboxyl groups (TC), the mixing ratio by mass (DIC:TC) is not particularly limited and may be appropriately selected depending on the intended purpose. Preferably, the mixing ratio (DIC:TC) is 100:0.01 to 100:10, more preferably 100:0.01 to 100:1.

In polycondensation reaction between the polyol (PO) and the polycarboxylic acid (PC), the mixing ratio of PO to PC is not particularly limited and may be appropriately selected depending on the intended purpose. The mixing ratio PO/PC is preferably 2/1 to 1/1, more preferably 1.5/1 to 1/1, particularly preferably 1.3/1 to 1.02/1, in terms of the equivalent ratio ([OH]/[COOH]) of hydroxyl group [OH] in the polyol (PO) to carboxyl group [COOH] in the polycarboxylic acid (PC).

The polyol (PO) content of the isocyanate group-containing polyester prepolymer (A) is not particularly limited and may be appropriately selected depending on the intended purpose. For example, it is preferably 0.5% by mass to 40% by mass, more preferably 1% by mass to 30% by mass, particularly preferably 2% by mass to 20% by mass. When the polyol (PO) content is less than 0.5% by mass, the formed toner may be degraded in hot offset resistance to make it difficult for the toner to attain both desired heat resistance storage stability and desired low-temperature fixing property. When the polyol (PO) content is more than 40% by mass, the formed toner may have degraded low-temperature fixing property.

The polyisocyanate (PIC) is not particularly limited and may be appropriately selected depending on the intended purpose. Examples thereof include aliphatic polyisocyanates, alicyclic polyisocyanates, aromatic diisocyanates, aromatic/aliphatic diisocyanates, isocyanurates, phenol derivatives thereof, and blocked products thereof with oxime or caprolactam.

Examples of the aliphatic polyisocyanate include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate.

Examples of the alicyclic polyisocyanate include isophorone diisocyanate and cyclohexylmethane diisocyanate.

Examples of the aromatic diisocyanate include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate.

Examples of the aromatic/aliphatic diisocyanate include α,α,α',α'-tetramethylxylylene diisocyanate.

Examples of the isocyanurate include tris-isocyanatoalkyl-isocyanurate and triisocyanatoalkyl-isocyanurate.

These may be used alone or in combination.

In reaction between the polyisocyanate (PIC) and the polyester resin having an active hydrogen group (e.g., hydroxyl group-containing polyester resin), the ratio of the PIC to the hydroxyl group-containing polyester resin is preferably 5/1 to 1/1, more preferably 4/1 to 1.2/1, particularly preferably 3/1 to 1.5/1, in terms of the mixing equivalent ratio ([NCO]/[OH]) of isocyanate group [NCO] in the polyisocyanate (PIC) to hydroxyl group [OH] in the hydroxyl group-containing polyester resin. When the mixing equivalent ratio [NCO]/[OH] is more than 5, the formed toner may be degraded in low-temperature fixing property; whereas when the mixing equivalent ratio [NCO]/[OH] is less than 1, the formed toner may be degraded in offset resistance.

The polyisocyanate (PIC) content of the isocyanate group-containing polyester prepolymer (A) is not particularly limited and may be appropriately selected depending on the intended purpose. For example, it is preferably 0.5% by mass to 40% by mass, more preferably 1% by mass to 30% by mass, particularly preferably 2% by mass to 20% by mass. When the polyisocyanate (PIC) content is less than 0.5% by mass, the formed toner may be degraded in hot offset resistance to make it difficult for the toner to attain both desired heat resistance/storage stability and desired low-temperature fixing property. When the polyisocyanate (PIC) content is more than 40% by mass, the formed toner may be degraded in low-temperature fixing property.

The average number of isocyanate groups per molecule of the isocyanate group-containing polyester prepolymer (A) is not particularly limited but is preferably one or more, more preferably 1.2 to 5, still more preferably 1.5 to 4. When the average number of the isocyanate groups is less than one per molecule, the molecular weight of the polyester resin modified with a urea bond-forming group (RMPE) decreases, resulting in that the formed toner may be degraded in hot offset resistance.

The weight average molecular weight (Mw) of the polymer (prepolymer) reactive with the active hydrogen group-containing compound is not particularly limited but preferably 3,000 to 40,000, more preferably 4,000 to 30,000 based on the molecular weight distribution obtained by analyzing tetrahydrofuran (THF) soluble matter of the prepolymer through gel permeation chromatography (GPC). When the weight average molecular weight (Mw) is lower than 3,000, the formed toner may be degraded in heat resistance storage stability; whereas when the Mw is higher than 40,000, the formed toner may be degraded in low-temperature fixing property.

The gel permeation chromatography (GPC) for determining the molecular weight can be performed, for example, as follows. Specifically, a column is conditioned in a heat chamber at 40° C., and then tetrahydrofuran (THF) (column solvent) is caused to pass through the column at a flow rate of 1 mL/min while the temperature is being maintained. Subsequently, a separately prepared tetrahydrofuran solution of a resin sample (concentration; 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Co.; i.e., those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector which can be used is a refractive index (RI) detector.

The binder resin preferably exhibits adhesiveness to a recording medium such as paper, and contains an adhesive polymer obtained through reaction in an aqueous medium between the active hydrogen group-containing compound and the polymer reactive with the active hydrogen group-containing compound.

The weight average molecular weight of the binder resin is not particularly limited and may be appropriately selected depending on the intended purpose. It is preferably 3,000 or higher, more preferably 5,000 to 1,000,000, particularly preferably 7,000 to 500,000. Since the weight average molecular weight is lower than 3,000, the formed toner may be degraded in hot offset resistance.

The glass transition temperature (Tg) of the binder resin is not particularly limited and may be appropriately selected depending on the intended purpose. The glass transition temperature of the binder resin is preferably 30° C. to 70° C., more preferably 40° C. to 65° C.

When the glass transition temperature (Tg) is lower than 30° C., the formed toner may be degraded in heat resistance storage stability. When the glass transition temperature (Tg) is higher than 70° C., the formed toner may have insufficient low-temperature fixability. In the above toner, there exists a polyester resin subjected to crosslinking reaction and elongation reaction. Accordingly, even when the glass transition temperature is lower than that of the conventional polyester toner, better storage stability can be realized as compared with the conventional polyester toner.

The glass transition temperature (Tg) is determined in the following manner using a thermal analyzer (TA-60WS, product of Shimadzu Co.) and a differential scanning calorimeter (DSC-60, product of Shimadzu Co.) as measuring devices under the conditions given below.

Measurement Conditions

Sample container: aluminum sample pan (with a lid)
Sample amount: 5 mg
Reference: aluminum sample pan (10 mg of alumina)
Atmosphere: nitrogen (flow rate: 50 mL/min)
Temperature condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

The obtained measurements are analyzed using data analysis software (TA-60, version 1.52) available from Shimadzu Co. The analysis is performed by specifying a range of ±5° C. around a point showing the maximum peak in the lowest temperature side of DrDSC curve, which was the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponds to the glass transition temperature (Tg) of the toner.

Next, specific production examples of the binder resin or binder resin precursor will be described.

The binder resin is not particularly limited and may be appropriately selected depending on the intended purpose. Particularly preferred is a polyester resin.

The polyester resin is not particularly limited and may be appropriately selected depending on the intended purpose. Particularly preferable examples thereof include urea-modified polyester resins, and unmodified polyester resins.

The urea-modified polyester resin is obtained by reacting, in the aqueous medium, amines (B) serving as the active hydrogen group-containing compound and an isocyanate group-containing polyester prepolymer (A) serving as the polymer reactive with the active hydrogen group-containing compound.

The urea-modified polyester resin may contain a urethane bond, as well as a urea bond. In this case, a molar ratio (urea bond/urethane bond) of the urea bond to the urethane bond is not particularly limited and may be appropriately selected depending on the intended purpose. It is preferably 100/0 to 10/90, more preferably 80/20 to 20/80, particularly preferably 60/40 to 30/70. In the case where the molar ratio of the urea bond is less than 10, the formed toner may be degraded in hot offset resistance.

Preferred examples of the urea-modified polyester resin and the unmodified polyester resin include the following.

(1) a mixture of: a polycondensation product of bisphenol A ethyleneoxide (2 mol) adduct and isophthalic acid; and a compound obtained by urea-modifying a polyester prepolymer with isophorone diamine, wherein the polyester prepolymer is obtained by reacting a polycondensation product of bisphenol A ethyleneoxide (2 mol) adduct and isophthalic acid with isophorone diisocyanate.

(2) a mixture of: a polycondensation product of bisphenol A ethyleneoxide (2 mol) adduct and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct and isophthalic acid with isophorone diisocyanate.

(3) a mixture of: a polycondensation product of bisphenol A ethyleneoxide (2 mol) adduct/bisphenol A propyleneoxide (2 mol) adduct, and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct/bisphenol A propyleneoxide (2 mol) adduct, and terephthalic acid with isophorone diisocyanate.

(4) a mixture of: a polycondensation product of bisphenol A propyleneoxide (2 mol) adduct, and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct/bisphenol A propyleneoxide (2 mol) adduct, and terephthalic acid with isophorone diisocyanate.

(5) a mixture of: a polycondensation product of bisphenol A ethyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and terephthalic acid with isophorone diisocyanate.

(6) a mixture of: a polycondensation product of bisphenol A ethyleneoxide (2 mol) adduct/bisphenol A propyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and terephthalic acid with isophorone diisocyanate.

(7) a mixture of: a polycondensation product of bisphenol A ethyleneoxide (2 mol) adduct, and terephthalic acid; and a compound obtained by urea-modifying a polyester prepolymer with ethylene diamine, wherein the polyester prepolymer is obtained by reacting a polycondensation product of bisphenol A ethyleneoxide (2 mol) adduct, and terephthalic acid with isophorone diisocyanate.

(8) a mixture of: a polycondensation product of bisphenol A ethylene oxide (2 mol) adduct, and isophthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and isophthalic acid with diphenylmethane diisocyanate.

(9) a mixture of: a polycondensation product of bisphenol A ethyleneoxide (2 mol) adduct/bisphenol A propyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct/bisphenol A propyleneoxide (2 mol) adduct, and terephthalic acid/dodecenylsuccinic anhydride with diphenylmethane diisocyanate.

(10) a mixture of: a polycondensation product of bisphenol A ethyleneoxide (2 mol) adduct, and isophthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and isophthalic acid with toluene diisocyanate.

The urea-modified polyester is formed by, for example, the following methods.

(1) The solution or dispersion liquid of the toner material containing the polymer reactive with the active hydrogen group-containing compound (e.g., the isocyanate group-containing polyester prepolymer (A)) is emulsified or dispersed in the aqueous medium together with the active hydrogen group-containing compound (e.g., the amine (B)) so as to form oil droplets, and these two compounds are allowed to proceed with the elongation reaction and/or crosslinking reaction in the aqueous medium.

(2) The solution or dispersion liquid of the toner material is emulsified or dispersed in the aqueous medium, to which the active hydrogen group-containing compound has previously been added, so as to form oil droplets, and these two compounds are allowed to proceed with the elongation reaction and/or crosslinking reaction in the aqueous medium.

(3) The solution or dispersion liquid of the toner material is added and mixed in the aqueous medium, the active hydrogen group-containing compound is added thereto so as to form oil droplets, and these two compounds are allowed to proceed with the elongation reaction and/or crosslinking reaction from the surfaces of the particles in the aqueous medium.

In the case of (3), the modified polyester resin is preferentially formed at the surface of the toner particle to be formed, and thus the concentration gradation of the modified polyester can be provided within the toner particle.

The reaction conditions for forming the binder resin through emulsification or dispersion are not particularly limited and may be appropriately selected depending on the combination of the active hydrogen group-containing compound and the polymer reactive with the active hydrogen group-containing compound. The reaction time is preferably 10 minutes to 40 hours, more preferably 2 hours to 24 hours.

The method for stably forming the dispersoids containing the polymer reactive with the active hydrogen group-containing compound (e.g., the isocyanate group-containing polyester prepolymer (A)) in the aqueous medium is such that the toner solution or dispersion liquid, which is prepared by dissolving and/or dispersing the toner material containing the polymer reactive with the active hydrogen group-containing compound (e.g. the isocyanate group-containing polyester prepolymer (A)), the colorant, the releasing agent, the charge controlling agent and the unmodified polyester is added to the aqueous medium, and then dispersed by shearing force.

In emulsification and/or dispersion, the amount of the aqueous medium used is preferably 50 parts by mass to 2,000 parts by mass, particularly preferably 100 parts by mass to 1,000 parts by mass, per 100 parts by mass of the toner material. When the amount of the aqueous medium used is less than 50 parts by mass, the toner material is poorly dispersed, resulting in that toner particles having a predetermined particle diameter are not obtained in some cases. When the amount of the aqueous medium used is more than 2,000 parts by mass, the production cost is elevated.

—Other Components—

The other components are not particularly limited and may be appropriately selected depending on the intended purpose. Examples thereof include colorants, releasing agents, charge controlling agents, fine inorganic particles, flowability improvers, cleaning improvers, magnetic materials and metal soaps.

—Colorant—

The colorant is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These colorants may be used alone or in combination.

The amount of the colorant contained in the toner is not particularly limited and may be appropriately selected depending on the intended purpose. It is preferably 1% by mass to 15% by mass, more preferably 3% by mass to 10% by mass.

When the amount of the colorant is less than 1% by mass, the formed toner may be degraded in coloring performance. Whereas when the amount of the colorant is more than 15% by mass, the pigment is not sufficiently dispersed in the toner, potentially leading to a drop in coloring performance and degradation in electrical characteristics of the formed toner.

The colorant may be mixed with a resin to form a masterbatch.

The resin is not particularly limited and may be appropriately selected from those known in the art depending on the intended purpose. Examples thereof include polyesters, polymers of a substituted or unsubstituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes. These resins may be used alone or in combination.

Examples of the polymers of a substituted or unsubstituted styrene include polyester resins, polystyrenes, poly(p-chlorostyrenes) and polyvinyltoluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be prepared by mixing or kneading the colorant with the resin for use in the masterbatch through application of high shearing force. Preferably, an organic solvent may be used for improving the interactions between the colorant and the resin.

Furthermore, a so-called flashing method is preferably used, since a wet cake of the colorant can be directly used (i.e., no drying is required). Here, the flashing method is a method in which an aqueous paste containing a colorant is mixed or kneaded with a resin and an organic solvent, and then the colorant is transferred to the resin to remove the water and the organic solvent. In this mixing/kneading, for example, a high-shearing disperser (e.g., a three-roll mill) is preferably used. The colorant can be incorporated as desired into any of a first resin phase and a second resin phase by utilizing the difference in affinity to two different resins. As has been known well, when exists in the surface of the toner, the colorant degrades charging performance of the toner. Thus, by selectively incorporating the colorant into the first resin phase which is the inner layer, the formed toner can be improved in charging performances (e.g., environmental stability, charge retainability and charging amount).

—Releasing Agent—

The releasing agent is not particularly limited and may be appropriately selected depending on the intended purpose. The melting point thereof is preferably low; i.e., 50° C. to 120° C. When dispersed together with the above resins, such a low-melting-point releasing agent effectively exhibits its releasing effects on the interface between a fixing roller and each toner particle. Thus, even when an oil-less mechanism is employed (in which a releasing agent such as oil is not applied onto a fixing roller), good hot offset resistance is attained.

Preferred examples of the releasing agent include waxes.

Examples of the waxes include: natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes and polyethylene waxes); and synthetic waxes (e.g., ester waxes, ketone waxes and ether waxes). Further examples include fatty acid amides such as 12-hydroxystearic acid amide, stearic amide, phthalic anhydride imide and chlorinated hydrocarbons; low-molecular-weight crystalline polymer resins such as acrylate homopolymers (e.g., poly-n-stearyl methacrylate and poly-n-lauryl methacrylate) and acrylate copolymers (e.g., n-stearyl acrylate-ethyl methacrylate copolymers); and crystalline polymers having a long alkyl group in the side chain thereof. These releasing agents may be used alone or in combination.

The melting point of the releasing agent is not particularly limited and may be appropriately selected depending on the intended purpose. The melting point is preferably 50° C. to 120° C., more preferably 60° C. to 90° C. When the melting point is lower than 50° C., the wax may adversely affect the heat resistance storage stability of the toner. When the melting point is higher than 120° C., cold offset is easily caused upon fixing at lower temperatures.

The melt viscosity of the releasing agent is, measured at the temperature 20° C. higher than the melting point of the wax, preferably 5 mPa·s to 1,000 mPa·s (5 cps to 1,000 cps), more preferably 10 mPa·s to 100 mPa·s (10 cps to 100 cps). When the melt viscosity is lower than 5 mPa·s (5 cps), the formed toner may degrade in releasing ability. When the melt viscosity is higher than 1,000 mPa·s (1,000 cps), the hot offset resistance and the low-temperature fixability cannot be improved in some cases.

The amount of the releasing agent contained in the toner is not particularly limited and may be appropriately selected depending on the intended purpose. The amount of the releasing agent is preferably 0% by mass to 40% by mass, more preferably 3% by mass to 30% by mass. When the amount is higher than 40% by mass, the formed toner may be degraded in flowability.

The releasing agent can be incorporated as desired into any of a first resin phase and a second resin phase by utilizing the difference in affinity to two different resins. By selectively incorporating the releasing agent into the second resin phase which is the outer layer of the toner, the releasing agent oozes out satisfactorily even in a short heating time upon fixation and, consequently, satisfactory releasability can be realized. On the other hand, by selectively incorporating the releasing agent into the first resin phase which is the inner layer, the spent of the releasing agent to other members such as the photoconductors and carriers can be suppressed.

—Charge Controlling Agent—

The charge controlling agent is not particularly limited and may be appropriately selected from those known in the art depending on the intended purpose. Examples thereof include nigrosine dyes, triphenylmethane dyes, chrome-containing metal complex dyes, molybdenum acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. These may be used alone or in combination.

Also, the charge controlling agent may be a commercially available product. The commercially available product may be, for example, resins or compounds each having a functional group with an electron-donating property, azo dyes and metal complexes of organic acids. Specific examples thereof include BONTRON 03 (nigrosine dye), BONTRON P-51 (quaternary ammonium salt), BONTRON S-34 (metal-containing azo dye), E-82 (oxynaphthoic acid-based metal complex), E-84 (salicylic acid-based metal complex) and E-89 (phenol condensate) (these products are of ORIENT CHEMICAL INDUSTRIES CO., LTD); TN-105 (metal complex of salicylic acid) and TP-302 and TP-415 (quaternary ammonium salt molybdenum complex (these products are of Hodogaya Chemical Co.)); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (these products are of Hoechst AG); LRA-901 and LR-147 (boron complex) (these products are of Japan Carlit Co., Ltd.); copper phthalocyanine; perylene; quinacridone; azo pigments; and polymeric compounds having, as a functional group, a sulfonic acid group, carboxyl group or quaternary ammonium salt.

The charge controlling agent can be incorporated into a resin phase inside the toner particles by utilizing the difference in affinity for the resin inside the toner particles. By selectively incorporating the charge controlling agent into the resin phase, which is the inner layer, inside the toner particles, the spent of the charge controlling agent to other members such as the photoconductors and carriers can be suppressed.

—Fine Inorganic Particles—

The fine inorganic particles are used as an external additive for imparting, for example, fluidity, developability and chargeability to the toner particles.

The fine inorganic particles are not particularly limited and may be appropriately selected depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These fine inorganic particles may be used alone or in combination.

In addition to fine inorganic particles having a large particle diameter of 80 nm to 500 nm in terms of primary average particle diameter, fine inorganic particles having a small particle diameter can be preferably used as inorganic fine particles for assisting the fluidity, developability, and charging properties of the toner.

In particular, hydrophobic silica and hydrophobic titanium oxide are preferably used as the fine inorganic particles having a small particle diameter. The primary average particle diameter of the fine inorganic particles is preferably 5 nm to 50 nm, more preferably 10 nm to 30 nm.

The BET specific surface area of the fine inorganic particles is preferably 20 $m^2/g$ to 500 $m^2/g$.

The amount of the fine inorganic particles contained is preferably 0.01% by mass to 5% by mass, more preferably 0.01% by mass to 2.0% by mass.

—Flowability Improver—

The flowability improver is an agent improving hydrophobic properties through surface treatment, and is capable of inhibiting the degradation of flowability or chargeability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils.

It is preferable that the silica and titanium oxide (fine inorganic particles) be subjected to surface treatment with such a flowability improver and used as hydrophobic silica and hydrophobic titanium oxide.

—Cleanability Improver—

The cleanability improver is added to the toner to remove the developer remaining after transfer on a photoconductor or a primary transfer member.

Specific examples of the cleanability improver include metal salts of fatty acids such as stearic acid (e.g., zinc stearate and calcium stearate), and fine polymer particles formed by soap-free emulsion polymerization, such as fine polymethylmethacrylate particles and fine polystyrene particles.

The fine polymer particles have preferably a relatively narrow particle size distribution. It is preferable that the volume average particle diameter thereof be 0.01 μm to 1 μm.

—Magnetic Material—

The magnetic material is not particularly limited and may be appropriately selected from those known in the art depending on the intended purpose. Examples thereof include iron powder, magnetite and ferrite. Among them, one having a white color is preferable in terms of color tone.

<Emulsion or Dispersion Liquid-Preparing Step>

The emulsion or dispersion liquid-preparing step is a step of adding the solution or dispersion liquid to an aqueous medium for emulsification or dispersion, to thereby prepare an emulsion or dispersion liquid.

The method for emulsifying or dispersing the solution or dispersion liquid of the toner material in an aqueous medium is not particularly limited and may be appropriately selected depending on the intended purpose. The solution or dispersion liquid is preferably dispersed in the aqueous medium with stirring.

The method for dispersing the solution or dispersion liquid is not particularly limited and may be appropriately selected depending on the intended purpose. For example, known dispersers may be used for dispersion. The dispersers are not particularly limited, and examples thereof include low-speed shear dispersers and high-speed shear dispersers. During the emulsification or dispersion, the active hydrogen group-containing compound and the polymer (prepolymer) reactive with the active hydrogen group-containing compound are subjected to elongation reaction or crosslinking reaction, to thereby form an adhesive base material (binder resin).

—Aqueous Medium—

The aqueous medium is not particularly limited and may be appropriately selected from those known in the art. Examples thereof include water, water-miscible solvents and mixtures thereof. Among them, water is preferred.

The water-miscible solvent is not particularly limited, so long as it is miscible with water. Examples thereof include alcohols, dimethylformamide, tetrahydrofuran, cellsolves and lower ketones.

Examples of the alcohol include methanol, isopropanol and ethylene glycol.

Examples of the lower ketone include acetone and methyl ethyl ketone.

These may be used alone or in combination.

The aqueous medium used in the emulsion or dispersion liquid-preparing step preferably contains anionic fine resin particles and an anionic surfactant. In this case, the aqueous medium is preferably prepared by, for example, dispersing the anionic fine resin particles in the aqueous medium in the presence of the anionic surfactant.

The amount of the anionic surfactant or the anionic fine resin particles in the aqueous medium is not particularly limited and may be appropriately selected depending on the intended purpose. The amount of each of the anionic surfactant and the anionic fine resin particles is preferably 0.5 parts by mass to 10 parts by mass per 100 parts by mass of the aqueous medium.

—Anionic Fine Resin Particles—

The anionic fine resin particles are attached onto the surface of the toner, and fused to and integrated with the surface of the toner to form a relatively hard surface. Since the anionic fine resin particles have anionic properties, the anionic fine resin particles can adsorb on the liquid droplets containing the toner material to suppress coalescence between the liquid droplets. This is important for regulating the particle size distribution of the toner. Furthermore, the anionic fine resin particles can impart negative chargeability to the toner. In order to attain these effects, the anionic fine resin particles preferably have an average particle diameter 5 nm to 50 nm, more preferably 10 nm to 25 nm.

The average particle diameter is that of primary particles of anionic fine resin particles. The average particle diameter of the primary particles can be measured by, for example, SEM (scanning electron microscope), TEM (transmission electron microscope) or a light scattering method. Specifically, a particle size distribution analyzer (LA-920, product of HORIBA, Ltd.) based on a laser scattering method can be used for measurement so that the primary particles are diluted to a proper concentration falling within the measurement range. The average particle diameter of the primary particles is determined as the volume average diameter.

The resin of the anionic fine resin particles is not particularly limited, as long as it can be dispersed in the aqueous medium to form an aqueous dispersion liquid, and may be appropriately selected from those known in the art depending on the intended purpose.

The resin is not particularly limited and may be a thermoplastic or thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination.

Preferably, at least one selected from vinyl resins, polyurethane resins, epoxy resins and polyester resins is dispersed in the aqueous medium, from the viewpoint of easily preparing an aqueous dispersion liquid containing fine spherical resin particles.

Notably, the vinyl resin is a homopolymer or copolymer of a vinyl monomer. Examples thereof include styrene-(meth) acrylate ester resins, styrene-butadiene copolymers, (meth) acrylic acid-acrylate ester polymers, styrene-acrylonitrile copolymers, styrene-maleic anhydride copolymers and styrene-(meth)acrylic acid copolymers.

The anionic fine resin particles must be anionic to avoid aggregation when used in combination with the above-described anionic surfactant.

The anionic fine resin particles can be prepared by using an anionic active agent in the below-described methods or by introducing into a resin an anionic group such as a carboxylic acid group and/or a sulfonic acid group.

The method for preparing the anionic fine resin particles is not particularly limited and may be appropriately selected depending on the intended purpose. Examples thereof include a method of polymerizing using a known polymerization method and a method of preparing an aqueous dispersion liquid of fine resin particles. Of these, the latter method is preferred.

The method of preparing the aqueous dispersion liquid of fine resin particles is preferably as follows, for example:

(1) a method in which an aqueous dispersion liquid of fine resin particles A is directly produced by subjecting vinyl monomers serving as a starting material to polymerization reaction with any one of the suspension polymerization method, the emulsification polymerization method, the seed polymerization method and the dispersion polymerization method;

(2) a method in which an aqueous dispersion of fine resin particles A of polyadded or condensed resins (e.g., polyester resins, polyurethane resins and epoxy resins) is produced by dispersing their precursor (e.g., monomer or oligomer) or a solution thereof in an aqueous medium in the presence of an appropriate dispersant and then curing the resultant dispersion with heating or through addition of a curing agent;

(3) a method in which an aqueous dispersion of particles of polyadded or condensed resins (e.g., polyester resins, polyurethane resins and epoxy resins) is produced by dissolving an appropriate emulsifier in their precursor (e.g., monomer or oligomer) or a solution thereof (which is preferably a liquid or may be liquefied with heating) and then adding water to the resultant mixture for phase inversion emulsification;

(4) a method in which a resin is prepared through polymerization reaction (e.g., addition polymerization, ring-opening polymerization, polyaddition, addition condensation or condensation polymerization); the thus-prepared resin is pulverized using, for example, a mechanically rotary pulverizer or a jet pulverizer, and then classified; and the thus-formed fine resin particels are dispersed in water in the presence of an appropriate dispersant;

(5) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is sprayed to produce fine resin particles; and the thus-produced fine resin particles are dispersed in water in the presence of an appropriate dispersant;

(6) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution, followed by addition of a bad solvent for precipitation, or the thus-prepared resin is dissolved with heating in a solvent to prepare a resin solution, followed by cooling for precipitation; the solvent is removed to produce fine resin particles; and the thus-produced fine resin particles are dispersed in water in the presence of an appropriate dispersant;

(7) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is dispersed in an aqueous medium in the presence of an appropriate dispersant; and the solvent is removed with heating or under reduced pressure; and (8) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; an appropriate emulsifier is dissolved in the thus-prepared resin solution; and water is added to the resultant solution for phase inversion emulsification.

—Anionic Surfactant—

The anionic surfactant is not particularly limited and may be appropriately selected depending on the intended purpose. Examples thereof include alkylbenzenesulfonic acid salts, α-olefin sulfonic acid salts and phosphoric acid esters, with anionic surfactants having a fluoroalkyl group being preferred. Examples of the anionic surfactants having a fluoroalkyl group include fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids (C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl(C6 to C10)-N-ethylsulfonylglycin, monoperfluoroalkyl(C6 to C16) ethylphosphates and sodium dodecyldiphenyl ether disulfonate.

Examples of commercially available products of the fluoroalkyl group-containing anionic surfactants include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

In the toner obtained using the aqueous medium containing the anionic surfactant and the anionic fine resin particles having an average particle diameter of 5 nm to 50 nm, the anionic fine resin particles are attached onto the surfaces of the toner particles each containing as a nucleus the toner material including the colorant and the binder resin.

Notably, the average particle diameter of the toner is regulated by selecting proper emulsification or dispersion conditions such as stirring of the aqueous medium in the emulsion or dispersion liquid-preparing step.

The volume average particle diameter of the toner is not particularly limited but preferably 1 μm to 6 μm, more preferably 2 μm to 5 μm. When the volume average particle diameter of the toner is less than 1 μm, toner dust is likely to be generated in the primary transfer and the secondary transfer. On the other hand, when the volume average particle diameter of the toner is more than 6 μm, the dot reproducibility is unsatisfactory and the granularity of a halftone part is also deteriorated, potentially making it impossible to form a high-definition image.

For the aqueous medium, the following inorganic dispersants and polymer protective colloid may be used in combination with the anionic surfactant and the anionic fine resin particles. Examples of the inorganic dispersants having poor water solubility include tricalcium phosphate, calcium carbonate, titanium oxide, colloidal silica, and hydroxyapatite.

The polymer protective colloid is not particularly limited. Examples thereof include acids, (meth)acrylic monomers having a hydroxyl group, vinyl alcohols or ethers of vinyl alcohols, esters of vinyl alcohol and compounds having a carboxyl group, amide compounds or methylol compounds thereof, chlorides, homopolymers or copolymers of a compound containing a nitrogen atom or a nitrogen-containing heterocyclic ring, polyoxyethylene, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth)acrylic monomers having a hydroxyl group include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide.

Examples of the vinyl alcohols or ethers of vinyl alcohols include vinyl methyl ether, vinyl ethyl ether, and vinyl propyl ether.

Examples of the esters of vinyl alcohols and compounds having a carboxyl group include vinyl acetate, vinyl propionate, and vinyl butyrate.

Examples of the amide compounds or methylol compounds thereof include acryl amide, methacryl amide, diacetone acryl amide acid, and methylol compounds thereof.

Examples of the chlorides include acrylic acid chloride and methacrylic acid chloride.

Examples of the homopolymers or copolymers of a compound containing a nitrogen atom or a nitrogen-containing heterocyclic ring include vinyl pyridine, vinyl pyrrolidone, vinyl imidazole, and ethylene imine.

Examples of the polyoxy ethylene compounds include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene lauryl phenyl ether, polyoxyethylene stearyl phenyl ester, and polyoxyethylene nonyl phenyl ester.

Examples of the cellulose include methyl cellulose, hydroxyethyl cellulose, and hydroxypropyl cellulose.

When a dispersion stabilizer soluble in an acid or alkali (e.g., calcium phosphate) is used, the calcium phosphate can be removed from the particles by dissolving it with an acid such as hydrochloric acid, followed by washing with water; or by enzymatically decomposing it.

<Organic Solvent-removing Step>

The organic solvent-removing step is a step of removing the organic solvent from the emulsion or dispersion liquid (emulsified slurry).

The method for removing the organic solvent is not particularly limited and may be appropriately selected depending on the intended purpose. For example, the removal of the organic solvent is performed as follows: (1) the entire reaction system is gradually increased in temperature to completely evaporate the organic solvent contained in oil droplets; or (2) the emulsified dispersion is sprayed in a dry atmosphere to completely remove/evaporate the water insoluble organic solvent contained in oil droplets together with the aqueous dispersant, whereby fine toner particles are formed.

The thus-formed toner particles are subjected to, for example, washing and drying, and then, if necessary, to classification. Classification is performed by removing very fine particles using, for example, a cyclone, a decanter or a centrifugal separator in the liquid. Alternatively, after drying, the formed powdery toner particles may be classified.

The toner particles produced through the above-described steps may be mixed with other particles of, for example, a colorant, a releasing agent and a charge controlling agent, or a mechanical impact may be applied to the resultant mixture (toner particles) for preventing the releasing agent from dropping off the surface of the toner particles.

Examples of the method for applying a mechanical impact include a method in which an impact is applied to a mixture using a high-speed rotating blade; and a method in which a mixture is caused to pass through a high-speed airflow to form aggregated particles, followed by crushing against an appropriate collision plate.

Examples of apparatuses used in these methods include ONGMILL (product of Hosokawa Micron K.K.), an apparatus produced by modifying an I-type mill (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

<Characteristics of Toner>

The toner produced through the above steps has the following characteristics.

The average circularity of the toner is not particularly limited, so long as it is 0.950 to 0.990, and may be appropriately selected depending on the intended purpose. When the average circularity of the toner is less than 0.950, evenness of an image in the development is deteriorated, or the efficiency of transfer of the toner from the electrophotographic photoconductor to the intermediate transfer member or from the intermediate transfer member to the recording medium may be lowered. Consequently, uniform transfer cannot be realized in some cases. When the average circularity of the toner is more than 0.990, the toner particles run through the cleaning blade, potentially causing cleaning failures. According to the production process of the present invention, the toner is produced by emulsification treatment in the aqueous medium. This process is effective in reducing the particle diameter of the color toner and in realizing a toner shape having an average circularity in the above-defined range.

The average circularity of the toner is defined by the following equation: Average circularity X=(Circumferential length of a circle having the same area as projected particle area/Circumferential length of projected particle image)×100 (%). The average circularity of the toner can be measured by the following method. Specifically, it can be measured using a flow-type particle image analyzer (FPIA-2100, product of Sysmex Co.), and analyzed using an analysis software (FPIA-2100 Data Processing Program For FPIA Version00-10).

Specifically, into a 100 mL glass beaker, 0.1 mL to 0.5 mL of a 10% by mass surfactant (NEOGEN SC-A, which is an alkylbenzene sulfonate, product of Dai-ichi Kogyo Seiyaku Co., Ltd.) is added, 0.1 g to 0.5 g of the toner is added, the ingredients are stirred using a microspatula, then 80 mL of ion-exchanged water is added. The obtained dispersion liquid is subjected to dispersion treatment for 3 min using an ultrasonic wave dispersing device (product of Honda Electronics Co.). Using FPIA-2100 mentioned above, the shape and distribution of toner particles are measured after the dispersion liquid has been adjusted to have a concentration of 5,000 (number per μL) to 15,000 (number per μL).

In this measuring method, it is important in terms of reproducibility in measuring the average circularity that the above-mentioned dispersion liquid concentration is kept in the range of 5,000 number per μL to 15,000 number per μL. To obtain the above-mentioned dispersion liquid concentration, it is necessary to change the preparation conditions of the dispersion liquid; i.e., the amount of the surfactant added and the amount of the toner. The required amount of the surfactant varies depending on the hydrophobicity of the toner. When the surfactant is added in a large amount, noise is caused by foaming. When the surfactant is added in a small amount, the toner cannot be sufficiently wetted, leading to insufficient dispersion. Also, the amount of the toner added varies depending on its particle diameter. When the toner has a small particle diameter, it needs to be added in a small amount. When the toner has a large particle diameter, it needs to be added in a large amount. In the case where the toner particle diameter is 3 μm to 7 μm, the dispersion liquid concentration can be adjusted to fall in the range of 5,000 (number per μL) to 15,000 (number per μL) by adding 0.1 g to 0.5 g of the toner.

The charge amount of the toner is preferably 10 μC/g to 80 μC/g as charge amount Q (absolute value) obtained when the toner particles (7% by mass) and carrier particles are mixed together for 15 sec and 600 sec. When the charge amount Q (absolute value) is less than 10 μC/g, the attractive force becomes low between the toner particles and carrier particles. In this case, a larger amount of the toner is used for development even in a low developing field. As a result, high-quality images with gradation cannot be obtained in some cases. In addition, the amount of the toner having the opposite polarity increases, which may degrade image quality due to, for example, fogging since a larger amount of the toner is used for development of the white background. When the charge amount Q (absolute value) is higher than 80 μC/g, the attractive force becomes high between the toner particles and magnetic carrier particles. In this case, a smaller amount of the toner is used for development, which may lead to degradation in image quality.

The charge amount of the toner is measured with a V blow-off device (product of RICOH SOZO KAIHATU K.K.). The toner and the carrier are allowed to stand as a developer having a toner concentration of 7% by mass at 40° C. and 70% RH for 2 hr. The developer is then placed in a metallic gauge, followed by mixing with stirring in a stirring device at 285 rpm for 60 sec or 600 sec. One gram of the developer was weighed from 6 g of the initial developer, and the charge amount distribution of the toner is measured by a single mode method with a V blow-off device (product of RICOH SOZO KAIHATU K.K.). At the time of blow, an opening of 635 mesh is used. In the single mode method of the V blow-off device (product of RICOH SOZO KAIHATU K.K.), a single mode is selected according to the instruction manual, and measurement is performed under conditions of height 5 mm, suction 100, and blow twice.

The ratio of the volume average particle diameter (Dv) to the number average particle diameter (Dn), i.e., Dv/Dn, of the toner is not particularly limited and may be appropriately selected depending on the intended purpose. The ratio Dv/Dn is preferably 1.25 or less, more preferably 1.05 to 1.25. When the ratio Dv/Dn is less than 1.05, the following problems occur. Specifically, for a two-component developer, in stirring for a long period of time in a developing device, the toner is fused to the surface of the carrier, possibly leading to lowered charging ability of the carrier and deteriorated cleanability. For a one-component developer, filming of the toner on the developing roller and the fusion of the toner on a member such as a blade, which is used for forming a thin layer of the toner, are likely to occur. On the other hand, when the ratio Dv/Dn exceeds 1.25, high-quality images with a high resolution cannot be formed without difficulties. In this case, when the toner is introduced and consumed in a developer, a fluctuation in particle diameter of the toner may be increased. Also, the distribution of the charge amount of the toner is broadened, making it difficult to obtain a high-quality image.

When the ratio Dv/Dn is 1.25 or lower, the distribution of the charge amount becomes uniform, which reduces fogging on the background. When the ratio Dv/Dn is 1.05 to 1.25, the resultant toner is excellent in all of storage stability, low-temperature fixability, and hot offset resistance. In particular, when the toner is used in a full color copier, the gloss of images is excellent. In the two-component developer, even when the toner is introduced and consumed for a long period of time, no significant fluctuation in toner particle diameter within the developer occurs and, consequently, good, stable developing properties can be obtained even after long-term stirring in the developing device. For the one-component developer, even when the toner is introduced and consumed, a fluctuation in particle diameter of the toner can be reduced. Further, filming of the toner on the developing roller and the fusion of the toner on a member such as a blade, which is used for forming a thin layer of the toner, do not occur. Accordingly, when the developing device is used (stirred) for a long period of time, good, stable developing properties can be obtained and, consequently, high-quality images can be formed.

The volume average particle diameter (Dv) and the number average particle diameter (Dn) of the toner can be measured as follows. Specifically, using a particle size analyzer (Multisizer III, product of Beckman Coulter Co.) with the aperture diameter being set to 100 μm, and the obtained measurements are analyzed with an analysis software (Beckman Coulter Multisizer 3 Version 3.51).

More specifically, a 10% by mass surfactant (alkylbenzene sulfonate, Neogen SC-A, product of Daiichi Kogyo Seiyaku Co.) (0.5 mL) is added to a 100 mL-glass beaker, and a toner sample (0.5 g) is added thereto, followed by stirring with a microspartel. Subsequently, ion-exchange water (80 mL) is added to the beaker, and the obtained dispersion liquid is dispersed with an ultrasonic wave disperser (W-113MK-II, product of Honda Electronics Co.) for 10 min. The resultant dispersion liquid is measured using the above Multisizer III and Isoton III (product of Beckman Coulter Co.) serving as a solution for measurement. The dispersion liquid containing the toner sample is dropped so that the concentration indicated by the meter falls within a range of 8% by mass±2% by mass. Notably, in this method, it is important that the concentration is adjusted to 8% by mass ±2% by mass, considering attaining measurement reproducibility with respect to the particle diameter of the toner. No measurement error is observed, as long as the concentration falls within the above range.

The BET specific surface area of the toner of the present invention is preferably 0.5 $m^2/g$ to 4.0 $m^2/g$, more preferably 0.5 $m^2/g$ to 2.0 $m^2/g$. When the BET specific surface area is smaller than 0.5 $m^2/g$, the toner particles are covered densely with the fine resin particles, which impairs the adhesion between a recording paper sheet and the binder resin inside the toner particles. As a result, the minimum fixing temperature is elevated. In addition, the fine resin particles prevent wax from oozing out, resulting in that the releasing effect of the wax cannot be obtained to cause offset. When the BET specific surface area of the toner exceeds 4.0 $m^2/g$, fine organic particles remaining on the toner surface considerably project as protrusions. The fine resin particles remain as coarse multilayers and impair the adhesion between a recording paper sheet and the binder resin inside the toner particles. As a result, the minimum fixing temperature is elevated. In addition, the fine resin particles prevent wax from oozing out, resulting in that the releasing effect of the wax cannot be obtained to cause offset. Furthermore, the additives protrude to form irregularities in the toner surface, which easily affects the image quality.

The common logarithmic value Log ρ of the volume specific resistance ρ (Ωcm) of the toner of the present invention is preferably 10.9 Log Ωcm to 11.4 Log Ωcm. When the common logarithmic value Log ρ of the volume specific resistance ρ (Ωcm) of the toner is smaller than 10.9 Log Ωcm, the conductivity becomes higher to cause charging failures. As a result, background smear and/or toner scattering tend to increasingly occur. When it is greater than 11.4 Log Ωcm, the resistance becomes higher to increase the charge amount, resulting in that the image density may be decreased.

FIG. 1 schematically illustrates the structure of a toner of the present invention. As illustrated in FIG. 1, a toner particle 100 contains a toner base particle (toner particle main body) 101 and external additives 102. Here, the toner base particle 101 is made of the toner material, and the external additives 102 promote flowability, developability and chargeability of the colored toner particle. The external additives 102 are attached onto the uppermost surface of the toner base particle 101. Notably, the structure of the toner particle is not limited to that illustrated in FIG. 1. For example, a deforming agent may be used to deform the structure of the toner particle.

<Developer>

The developer is not particularly limited, so long as it contains the toner, and may be appropriately selected depending on the intended purpose. The developer may further contain carrier components. Examples of the developer include a one-component developer consisting of the toner and a two-component developer containing the toner and the carrier.

For high-speed printers responding to the recent increase in information processing speed, the two-component developer is preferably used from the viewpoint of, for example, elongating the service life. Such developer can be used in, for example, various known electrophotographic methods such as magnetic one-component developing methods, non-magnetic one-component methods and two-component developing methods. For the one-component developer, even when the toner is introduced and consumed, a fluctuation in particle diameter of the toner can be reduced. Further, filming of the toner on the developing roller and the fusion of the toner on a member such as a blade, which is used for forming a thin layer of the toner, do not occur. Accordingly, when the developing device is used (stirred) for a long period of time, good, stable developing properties can be obtained and, consequently, high-quality images can be formed. In the two-component developer, even when the toner is introduced and consumed for a long period of time, no significant fluctuation in toner particle diameter within the developer occurs and, consequently, good, stable developing properties can be obtained even after long-term stirring in the developing device.

When the toner is used together with a carrier to form a two-component developer, the weight average particle diameter of the carrier is not particularly limited but is preferably 15 μm to 40 μm.

When the weight average particle diameter is smaller than 15 μm, carrier adhesion, which is a phenomenon that the carrier is also disadvantageously transferred in the step of transfer, is likely to occur. When the weight average particle diameter is larger than 40 μm, the carrier adhesion is less likely to occur. In this case, however, when the toner density is increased to provide a high image density, there is a possibility that background smear is likely to occur. Further, when the dot diameter of the latent image is small, variation in dot reproducibility is so large that the granularity in highlight parts is likely to be deteriorated.

The amount of the carrier contained in the two-component developer is not particularly limited and may be appropriately selected depending on the intended purpose. The amount of the carrier is preferably 90% by mass to 98% by mass, more preferably 93% by mass to 97% by mass. When the amount of the carrier falls within the range of 93% by mass to 97% by mass, it is advantageous that development can be stably performed.

The carrier is not particularly limited and may be appropriately selected depending on the intended purpose. The carrier preferably has a core material and a resin layer coating the core material.

The material of the core material is not particularly limited and may be appropriately selected depending on the intended purpose. For example, it is preferable to employ manganese-strontium (Mn—Sr) materials (50 $A \cdot m^2/kg$ to 90 $A \cdot m^2/kg$) or manganese-magnesium (Mn—Mg) materials (50 $A \cdot m^2/kg$ to 90 $A \cdot m^2/kg$). These materials may be used alone or in combination.

Further, it is preferably to employ high magnetization materials such as iron powder (100 $A \cdot m^2/kg$ or more) or magnetite (75 $A \cdot m^2/kg$ to 120 $A \cdot m^2/kg$) for the purpose of securing image density. Moreover, it is preferably to employ low magnetization materials such as copper-zinc (Cu—Zn) with 30 $A \cdot m^2/kg$ to 80 $A \cdot m^2/kg$ because the impact toward the photoconductor having a toner in the form of magnetic brush can be relieved and because it is advantageous for higher image quality.

The volume-average particle diameter (D50) of the core material is not particularly limited and may be appropriately selected depending on the intended purpose. It is preferably 10 μm to 150 μm, more preferably 20 μm to 80 μM.

When the D50 is less than 10 μm, the amount of fine powder increases in the particle size distribution of the carrier, whereas magnetization per particle decreases and carrier scattering may occur. When the volume average particle diameter is greater than 150 μm, the specific surface area of the carrier decreases and thus toner scattering may occur. As a result, in the case of printing a full-color image having many solid portions, especially the reproduction of the solid portions may decrease.

When the volume-average particle diameter (D50) of the core material falls within the range of 20 μm to 80 μm, it is advantageous that development can be stably performed.

The material of the resin layer covering the core material is not particularly limited and may be appropriately selected depending on the intended purpose. Examples thereof include amino resins, polyvinyl resins, polystyrene resins, halogenated polyolefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymers of tetrafluoroethylene, vinylidene fluoride and monomer having no fluorine-containing group, and silicone resins. These may be used alone or in combination.

The amino resins are not particularly limited and may be appropriately selected depending on the intended purpose. Examples thereof include urea-formaldehyde resins, melamine resins, benzoguanamine resins, urea resins, polyamide resins and epoxy resins.

The polyvinyl resins are not particularly limited and may be appropriately selected depending on the intended purpose. Examples thereof include acrylic resins, polymethyl methacrylate, polyacrylonitrile, polyvinyl acetate, polyvinyl alcohol and polyvinyl butyral.

The polystyrene resins are not particularly limited and may be appropriately selected depending on the intended purpose. Examples thereof include polystyrene and styrene-acrylic copolymers.

The halogenated polyolefins are not particularly limited and may be appropriately selected depending on the intended purpose. Examples thereof include polyvinyl chloride.

The polyester resins are not particularly limited and may be appropriately selected depending on the intended purpose. Examples thereof include polyethylene terephtalate and polybutylene terephtalate.

If necessary, the resin layer may contain, for example, electrically conductive powder as necessary. The electrically conductive powder is not particularly limited and may be appropriately selected depending on the intended purpose. Examples thereof include metal powder, carbon black, titanium oxide, tin oxide, and zinc oxide.

The average particle diameter of the electrically conductive powder is not particularly limited and may be appropriately selected depending on the intended purpose. It is preferably 1 μm or less. When the average particle diameter is greater than 1 μm, it may be difficult to control the electrical resistance.

The resin layer may be formed by uniformly coating a surface of the core material with a coating solution obtained by dissolving a silicone resin or other resins in a solvent, by a known coating method, followed by drying and baking.

The coating method is not particularly limited and may be appropriately selected depending on the intended purpose. Examples thereof include dipping, spraying, and brushing.

The solvent is not particularly limited and may be appropriately selected depending on the intended purpose. Examples thereof include toluene, xylene, methyl ethyl ketone, methyl isobutyl ketone, cellosolve, and butyl acetate.

The baking method is not particularly limited and may be appropriately selected depending on the intended purpose. It may be external heating or internal heating. Examples of the baking method include methods using fixed electric furnace, fluid electric furnace, rotary electric furnace, burner furnace, or microwaves.

The amount of the resin layer in the carrier is not particularly limited and may be appropriately selected depending on the intended purpose. It is preferably 0.01% by mass to 5.0% by mass. When the amount of the resin layer is less than 0.01% by mass, the resin layer cannot be uniformly formed over the surface of the core material. When the amount of the resin layer is more than 5.0% by mass, the resin layer becomes so thick that fusing of carrier particles occurs and thus equally-sized carrier particles cannot be obtained in some cases.

The characteristics of the carrier can be measured with the following methods.

<Weight Average Particle Diameter>

The weight average particle diameter Dw of the carrier is calculated on the basis of the particle size distribution of the particles measured on a number basis; i.e., the relation between the number based frequency and the particle diameter. In this case, the weight average particle diameter Dw is expressed by the following equation (1):

$$Dw=\{1/\Sigma(nD^3)\}\times\{\Sigma(nD^4)\} \quad \text{Equation (1)}$$

where D represents a typical particle diameter (μm) of particles present in each channel, and "n" represents the total number of particles present in each channel. It should be noted that each channel is a length for equally dividing the range of particle diameters in the particle size distribution chart, and 2 μm can be employed for each channel in the present invention. For the typical particle diameter of particles present in each channel, the lower limit value of particle diameters of the respective channels can be employed.

In addition, the number average particle diameter Dp of the carrier or the carrier core material particles are calculated on the basis of the particle diameter distribution measured on a number basis. The number average particle diameter Dp is expressed by Equation (2):

$$Dp=(1/\Sigma N)\times\{\Sigma nD\} \quad \text{Equation (2)}$$

where N represents the total number of particles measured, "n" represents the total number of particles present in each channel and D represents the minimum particle diameter of the particles present in each channel (2 μm).

For a particle size analyzer used for measuring the particle size distribution, a micro track particle size analyzer (Model HRA9320-X100, product of Honewell Co.) may be used. The evaluation conditions are as follows.

(1) Scope of particle diameters: 8 μm to 100 μm
(2) Channel length (width): 2 μm
(3) Number of channels: 46
(4) Refraction index: 2.42

(Image Forming Method)

An image forming method of the present invention includes: a charging step of charging an electrophotographic photoconductor; an exposing step of forming a latent electrostatic image on the charged electrophotographic photoconductor; a developing step of developing the latent electrostatic image with the toner of the present invention so as to form a toner image; a primary transfer step of primarily transferring the toner image onto an intermediate transfer member; a secondary transfer step of secondarily transferring the toner image, which has been transferred onto the intermediate transfer member, onto a recording medium by a secondary transfer unit; a fixing step of fixing the transferred toner image on the recording medium by a heat/pressure-applying member; and a cleaning step of removing toner remaining after transfer and adhered onto the surface of the electrophotographic photoconductor, from which the toner image has been transferred onto the intermediate transfer member by the primary transfer unit.

The image forming method is not particularly limited and may be appropriately selected depending on the intended purpose. Preferably, it is suitably used for forming a full-color image.

In the secondary transfer step, the linear velocity of transfer of the toner image onto the recording medium (so-called printing speed) is not particularly limited and may be appropriately selected depending on the intended purpose. It is preferably 300 mm/sec to 1,000 mm/sec. Also, the transfer time in the secondary transfer step is preferably 0.5 msec to 20 msec. Notably, the transfer time is a transfer time required for the transfer in the nip part between transfer rollers used for the secondary transfer.

As described above, the image forming method is not particularly limited and may be appropriately selected depending on the intended purpose. It is preferably of a tandem type where an image forming process including the charging step, the exposing step, the developing step, the primary transfer step, the secondary transfer step and the cleaning step is simultaneously performed in parallel per image formation.

In the tandem type, a plurality of electrophotographic photoconductors are provided, and development is performed one color by one color upon each rotation.

According to the tandem-type image forming process, the charging step, the exposing step, the developing step and the transfer step are performed for each color to form each color toner image. Accordingly, the difference in speed between single color image formation and full color image formation is so small that the tandem type can advantageously cope with high-speed printing.

In general, in the tandem-type image forming process, the color toner images are formed on respective separate electrophotographic photoconductors, and the color toner layers are stacked (color superimposition) to form a full color image. Accordingly, when a variation in properties such as a difference in charging characteristics between color toner particles exists, a difference in amount of the developing toner occurs between the respective color toner particles. As a result, a change in hue of secondary color by color superimposition is increased, and the color reproducibility may be lowered. The toner used in the image forming method of the tandem type should satisfy the requirements that the amount of the developing toner for regulating the balance of the colors is stabilized (no variation in developing toner amount between respective color toner particles), and the adherence to the electrophotographic photoconductor and to the recording medium is uniform between the respective color toner particles.

In this respect, use of the toner of the present invention in the developing step allows the tandem-type image forming method to exhibit its advantages, since the toner has uniform charging properties, no variation in respective toner particles, and uniform adherence to the electrophotographic photoconductor and to the recording medium between the respective color toner particles.

The charging step is not particularly limited but the charging unit preferably applies at least a direct current voltage obtained by superimposing alternating voltages. The application of the direct current voltage obtained by superimposing the alternating voltages can stabilize the surface voltage of the electrophotographic photoconductor to a desired value as compared with the application of only a direct current voltage. Accordingly, further uniform charging can be realized.

The charging step is not particularly limited but the charging unit preferably performs charging by bringing a charging member into contact with the electrophotographic photoconductor and applying the voltage to the charging member. When charging is carried out by bringing the charging member into contact with the electrophotographic photoconductor and applying the voltage to the charging member, the effect of uniform charging properties attained by applying the direct current voltage obtained by superimposing alternating voltages can be particularly improved.

The fixing step is not particularly limited but is preferably performed by a fixing unit including: a heating roller that is formed of a magnetic metal and is heated by electromagnetic induction; a fixation roller disposed parallel to the heating roller; an endless belt-like toner heating medium (a heating belt) that is taken across the heating roller and the fixation roller, is heated by a heating roller, and is rotated by these rollers; and a pressure roller that is brought into pressure contact with the fixation roller through the heating belt and is rotated in a forward direction relative to the heating belt to form a fixation nip part. The fixing step can realize a temperature rise in the fixation belt in a short time and can realize stable temperature control. Furthermore, even when a recording medium having a rough surface is used, during the fixation, the fixation belt acts in conformity to the surface of the transfer paper to some extent and, consequently, satisfactory fixability can be realized.

The fixing unit is not particularly limited but is preferably of an oil-less type or a minimal oil-coated fixing type. To this end, preferably, the toner particles to be fixed contain a releasing agent (wax) in a finely dispersed state in the toner particles. In the toner in which a releasing agent is finely dispersed in the toner particle, the releasing agent is likely to ooze out during fixation. Accordingly, in the oil-less fixing device or even when an oil coating effect has becomes unsatisfactory in the minimal oil-coated fixing device, the transfer of the toner to the belt can be suppressed.

In order that the releasing agent is present in a dispersed state in the toner particle, preferably, the releasing agent and the binder resin are not compatible with each other. The releasing agent can be finely dispersed in the toner particle, for example, by taking advantage of the shear force of kneading in the production of the toner. Whether the releasing agent is in a dispersed state can be determined by observing a thin film section of the toner particle under a TEM. The dispersion diameter of the releasing agent is not particularly limited but is preferably smaller. However, when the dispersion diameter is excessively small, oozing during the fixation is sometimes unsatisfactory. Accordingly, when the releasing agent can be observed at a magnification of 10,000 times, it can be determined that the releasing agent is present in a dispersed state. When the releasing agent is so small that the releasing agent cannot be observed at a magnification of 10,000 times, oozing of the releasing agent during the fixation is sometimes unsatisfactory even when the releasing agent is finely dispersed in the toner particle.

Referring now to the drawings, each of the steps of the image forming method will be described in more detail together with the unit used for the step.

Figure 2:
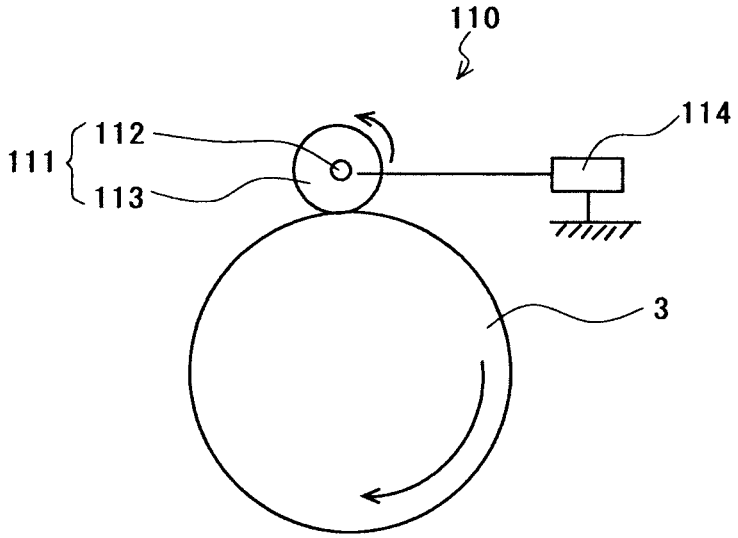
FIG. 2 is a schematic view of one exemplary contact-type roller charging device used in the present invention.
Figure 3:
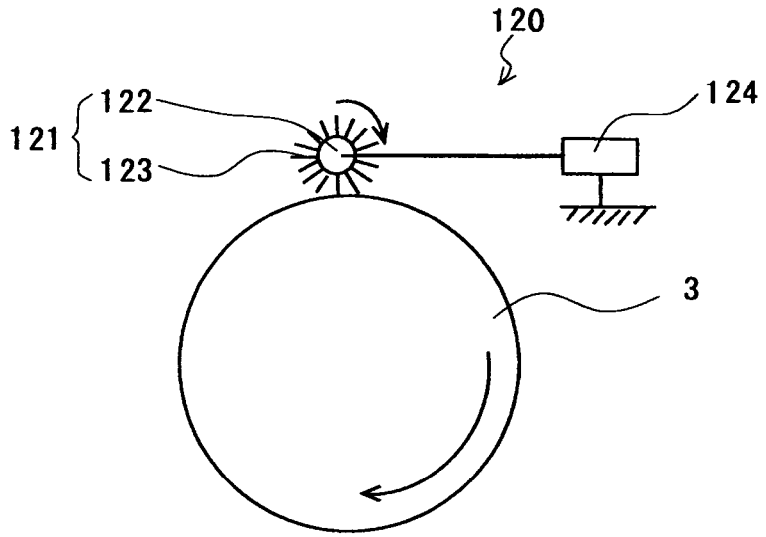
FIG. 3 is a schematic view of one exemplary contact-type brush charging device used in the present invention.

The charging device usable in the charging step may be, for example, a roller-type charging device illustrated in FIG. 2 and a fur brush-type charging device illustrated in FIG. 3.

FIG. 2 is a schematic configuration of an example of a roller-type charging device 110 which is one type of contact charging devices. A photoconductor 3 to be charged as an image bearing member is rotated at a predetermined speed (process speed) in the direction indicated by the arrow. A charging roller 111 serving as a charging member, which is brought into contact with the photoconductor 3, contains a metal core 112 and an electrically conductive rubber layer 113 formed on the outer surface of the metal core 112 in a shape of a concentric circle. The both terminals of the metal core 112 are supported with bearings so that the charging roller enables to rotate freely, and the charging roller is pressed against the photoconductor 3 at a predetermined pressure by a pressurizing unit. The charging roller 111 in FIG. 2 therefore rotates along with the rotation of the photoconductor 3. The charging roller 111 is generally formed with a diameter of 16 mm in which a metal core having a diameter of 9 mm is coated with the electrically conductive rubber layer 113 having a moderate resistance of approximately 100,000

Ω·cm. The power supply 114 illustrated in the figure is electrically connected to the metal core 112 of the charging roller 111, and a predetermined bias is applied to the charging roller 111 by the power supply 114. Thus, the surface of the photoconductor 3 is uniformly charged at a predetermined polarity and potential.

In addition to the roller-type charging device, the charging device may be, for example, a magnetic brush charging device or a fur brush charging device. It may be suitably selected according to a specification or configuration of an electrophotographic apparatus. When a magnetic brush is used as the charging device, the magnetic brush includes a charging member formed of various ferrite particles such as Zn—Cu ferrite, a non-magnetic electrically conductive sleeve to support the ferrite particles, and a magnetic roller included in the non-magnetic electrically conductive sleeve.

FIG. 3 is a schematic configuration of one example of a contact brush charging device 120. When a fur brush is used as the charging device, a material of the fur brush is, for example, a fur treated to be electrically conductive with, for example, carbon, copper sulfide, a metal or a metal oxide, and the fur is coiled or mounted to a metal or another metal core which is treated to be electrically conductive, thereby obtaining the charging device.

In the contact brush charging device 120 illustrated in FIG. 3, the photoconductor 3 to be charged (image bearing member) is rotated at a predetermined speed (process speed) in the direction indicated by the arrow. The fur brush roller 121 formed of the metal core 122 and a brush part 123 is brought in contact with the photoconductor 3, with a predetermined nip width and a predetermined pressure with respect to elasticity of the brush part 123.

The fur brush roller 121 as the contact charging device has an outer diameter of 14 mm and a longitudinal length of 250 mm. In this fur brush, a tape with a pile of electrically conductive rayon fiber (REC-B, product of Unitika Ltd.), as the brush part 123, is spirally coiled around the metal core 122 having a diameter of 6 mm, which serves also as an electrode. A brush of the brush part 123 is of 300 denier/50 filament, and a density of 155 fibers per 1 square millimeter. This role brush is once inserted into a pipe having an internal diameter of 12 mm with rotating in one direction, and is set so as to be a concentric circle relative to the pipe. Thereafter, the role brush in the pipe is left in an atmosphere of high humidity and high temperature so as to twist the fibers of the fur.

The resistance of the fur brush roller 121 is $1\times10^5\Omega$ at an applied voltage of 100 V. This resistance is calculated from the current obtained when the fur brush roller is contacted with a metal drum having a diameter of 30 mm with a nip width of 3 mm, and a voltage of 100 V is applied thereon. The resistance of the brush charging device 120 should be $10^4\Omega$ or more in order to prevent image defect caused by an insufficient charge at the charging nip part when the photoconductor 3 to be charged happens to have low electric strength defects such as pin holes thereon and an excessive leak current therefore runs into the defects. Moreover, it should be $10^7\Omega$ or less in order to sufficiently charge the surface of the photoconductor 3.

Examples of the material of the brush include, in addition to REC-B (product of Unitika Ltd.), REC-C, REC-M1, REC-M10 (product of Unitika Ltd.), SA-7 (product of Toray Industries, Inc.), THUNDERON (product of Nihon Sanmo Dyeing Co., Ltd.), BELTRON (product of Kanebo Gohsen, Ltd.), KURACARBO in which carbon is dispersed in rayon (product of Kuraray Co., Ltd.), and ROVAL (product of Mitsubishi Rayon Co., Ltd.). The brush is of preferably 3 denier to 10 denier per fiber, 10 filaments to 100 filaments per bundle, and 80 fibers to 600 fibers per square millimeter. The length of the fur is preferably 1 mm to 10 mm.

The fur brush roller 121 is rotated in the opposite (counter) direction to the rotation direction of the photoconductor 3 at a predetermined peripheral velocity, and comes into contact with a surface of the photoconductor with a velocity difference. The power supply 124 applies a predetermined charging voltage to the fur brush roller 121 so that the surface of the photoconductor is uniformly charged at a predetermined polarity and potential.

In contact charge of the photoconductor 3 by the fur brush roller 121, charges are mainly directly injected and the surface of the photoconductor 3 is charged at the substantially equal voltage to the applying charging voltage to the fur brush roller 511.

The charging member may be in any shape such as a charging roller or a fur blush, as well as the fur blush roller 121. The shape can be selected according to the specification and configuration of the image forming apparatus. When a charging roller is used, it generally includes a metal core and a rubber layer having a moderate resistance of about 100,000Ω·cm coated on the metal core. When a magnetic fur blush is used, it generally includes a charging member formed of various ferrite particles such as Zn—Cu ferrite, a non-magnetic electrically conductive sleeve to support the ferrite particles, and a magnet roll included in the non-magnetic electrically conductive sleeve.

Figure 4:
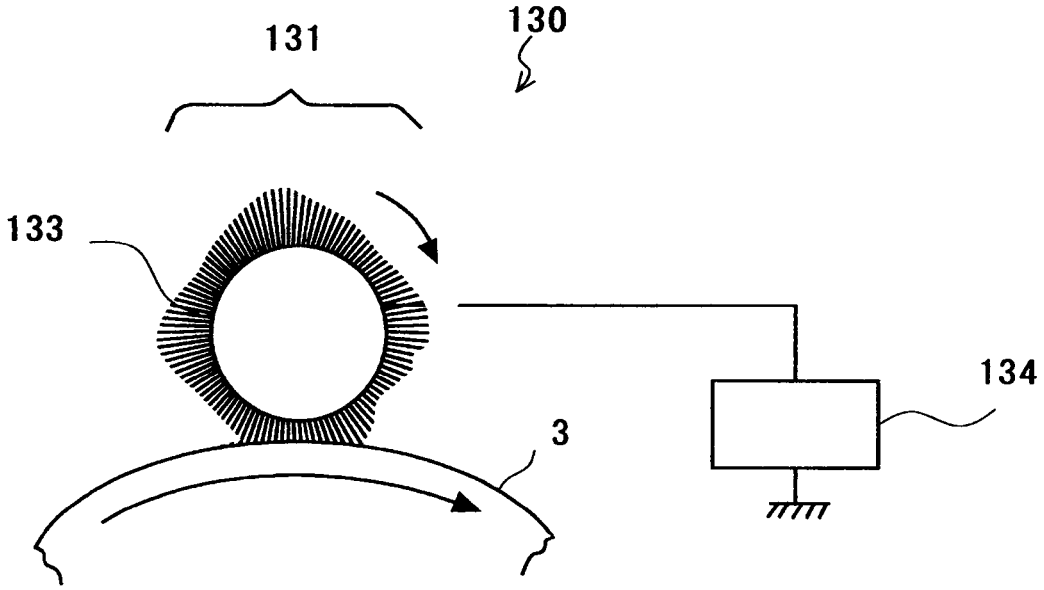
FIG. 4 is a schematic view of one exemplary magnetic brush charging device used in the present invention.

FIG. 4 illustrates a schematic configuration of one example of a magnetic brush charging device. The photoconductor 3 to be charged (image bearing member) is rotated at a predetermined speed (process speed) in the direction indicated by the arrow. The brush roller 131 having a magnetic brush is brought in contact with the photoconductor 3, with a predetermined nip width and a predetermined pressure with respect to elasticity of the brush part 133.

The magnetic brush as the contact charging member is formed of magnetic particles. For the magnetic particles, Zn—Cu ferrite particles having an average particle diameter of 25 μm and Zn—Cu ferrite particles having an average particle diameter of 10 μm are mixed together in a ratio by mass of 1:0.05, to thereby form magnetic particles having peaks at each average particle diameter and being obtained by coating the ferrite particles having an average particle diameter of 25 μm with a resin layer having a moderate resistance.

The contact charging member is formed of the aforementioned coated magnetic particles, a non-magnetic electrically conductive sleeve which supports the coated magnetic particles, and a magnet roller which is included in the non-magnetic electrically conductive sleeve. The coated magnetic particles are disposed on the sleeve with a thickness of 1 mm so as to form a charging nip of about 5 mm-wide with the photoconductor. The width between the non-magnetic electrically conductive sleeve and the photoconductor is adjusted to approximately 500 μm. The magnetic roller is rotated so as to subject the non-magnetic electrically conductive sleeve to rotate at twice in speed relative to the peripheral speed of the surface of the photoconductor, and in the opposite direction with the photoconductor. Therefore, the magnetic brush is uniformly in contact with the photoconductor.

Figure 5:
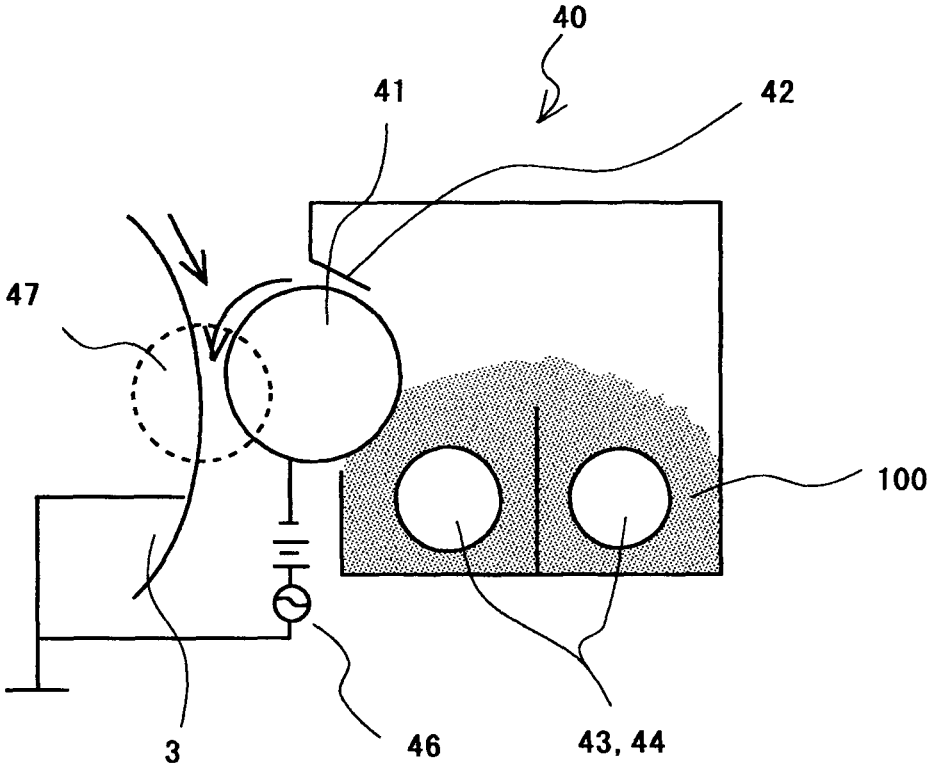
FIG. 5 is a schematic view of one exemplary developing device used in the present invention.

FIG. 5 illustrates an exemplary developing device. In the developing step, an alternating electrical field is preferably applied for developing the latent image on the photoconductor 3. In a developing device 40 illustrated in FIG. 5, a power supply 46 applies a vibration bias voltage as developing bias, in which a direct-current voltage and an alternating voltage are superimposed, to a developing sleeve 41 during development. The potential of background part and the potential of image part are between the maximum and the minimum of the vibration bias potential.

This forms an alternating electrical field, whose direction alternately changes, at a developing region 47. A toner and a carrier in the developer are vigorously vibrated in this alternating electrical field, so that the toner 100 overshoots the electrostatic force of constraint from the developing sleeve 41 and the carrier, and is attached to a latent image on the photoconductor 3. The toner 100 is a toner of the present invention.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential at the background and the potential at the image as mentioned above, and is preferably set closer to the potential at the background from the viewpoint of inhibiting a toner deposition (fogging) on the background.

When the vibration bias voltage is a rectangular wave, it is preferred that a duty ratio is adjusted to 50% or less. The duty ratio is a ratio of time when the toner leaps to the photoconductor 3 during one cycle of the vibration bias. In this way, the difference between the peak time value when the toner leaps to the photoconductor 3 and the time average value of bias can become very large. Consequently, the movement of the toner 100 becomes further activated hence the toner is attached with fidelity with respect to the potential distribution of the latent electrostatic image and rough deposits and image resolution can be improved. Moreover, the difference between the time peak value when the carrier having an opposite polarity of current to the toner 100 leaps to the photoconductor and the time average value of bias can be decreased. Consequently, the movement of the carrier can be restrained and the possibility of the carrier deposition on the background is largely reduced.

Figure 6:
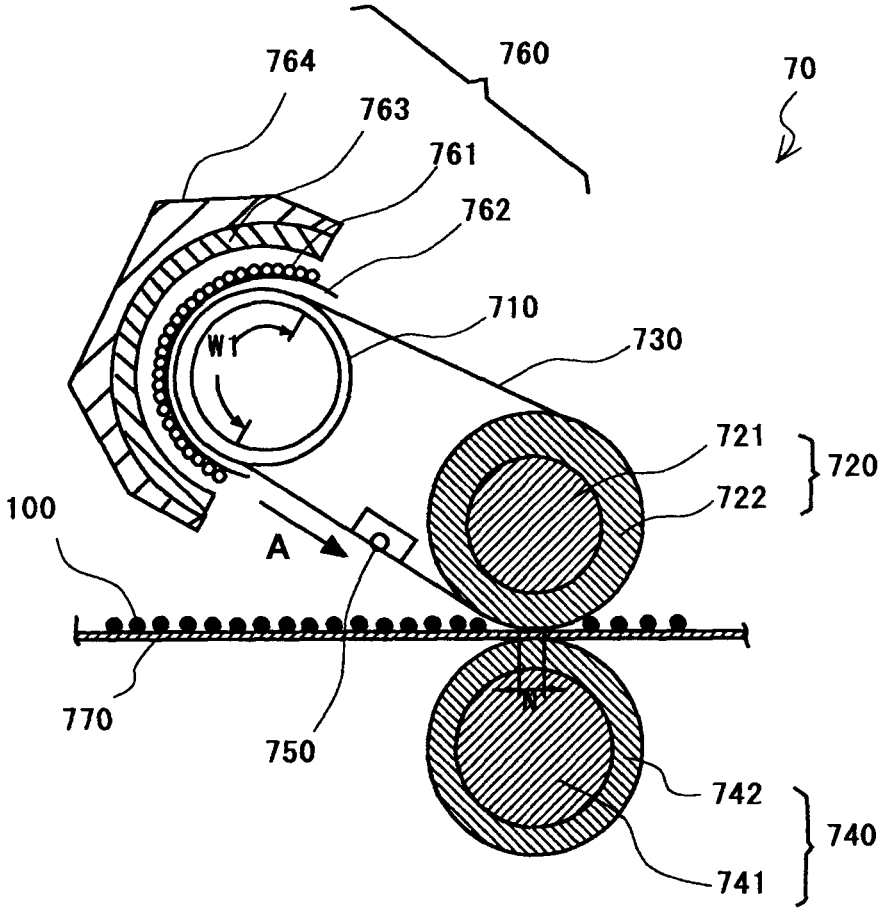
FIG. 6 is one exemplary schematic view of a fixing device used in the present invention.

The fixing device used in the fixing step may be, for example, a fixing device illustrated in FIG. 6. The fixing device 70 illustrated in FIG. 6 preferably includes a heating roller 710 which is heated by electromagnetic induction by means of an induction heating unit 760, a fixing roller 720 (facing rotator) disposed in parallel to the heating roller 710, a fixing belt (heat resistant belt, toner heating medium) 730, which is formed of an endless strip stretched between the heating roller 710 and the fixing roller 720 and which is heated by the heating roller 710 and rotated by any of these rollers in the direction indicated by arrow A, and a pressure roller 740 (pressing rotator) which is pressed against the fixing roller 720 via the fixing belt 730 and which is rotated in forward direction with respect to the fixing belt 730.

The heating roller 710 is a hollow cylindrical magnetic metal member made of, for example, iron, cobalt, nickel or an alloy of these metals. The heating roller 710 is 20 mm to 40 mm in outer diameter, and 0.3 mm to 1.0 mm in thickness, to be in configuration of low heat capacity and a rapid rise of temperature.

The fixing roller 720 (facing rotator) is formed of a metal core 721 made of metal such as stainless steel, and an elastic member 722 made of a solid or foam-like silicone rubber having heat resistance to be coated on the metal core 721. Furthermore, to form a contact section of a predetermined width between the pressure roller 740 and the fixing roller 720 by a compressive force provided by the pressure roller 740, the fixing roller 720 is constructed to be about 20 mm to about 40 mm in outer diameter to be larger than the heating roller 710. The elastic member 722 is about 4 mm to about 6 mm in thickness. Owing to this configuration, the heat capacity of the heating roller 710 is smaller than that of the fixing roller 720, so that the heating roller 710 is rapidly heated to make warm-up time period shorter.

The fixing belt 730 that is stretched between the heating roller 710 and the fixing roller 720 is heated at a contact section W1 with the heating roller 710 to be heated by the induction heating unit 760. Then, an inner surface of the fixing belt 730 is continuously heated by the rotation of the heating roller 710 and the fixing roller 720, and as a result, the whole belt will be heated.

Figure 7:
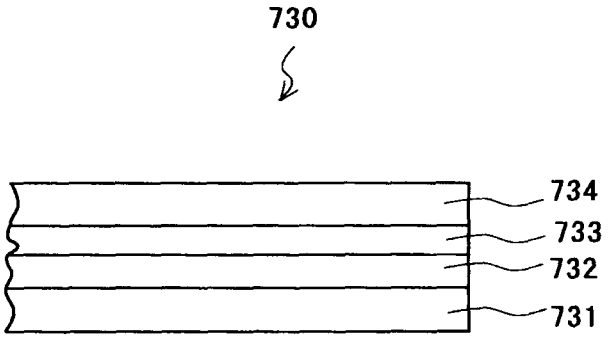
FIG. 7 is one exemplary layer structure of a fixing belt used in the present invention.

FIG. 7 illustrates a layer structure of the fixing belt 730. The fixing belt 730 has the following four layers in the order from an inner layer to a surface layer.

Substrate 731: a resin layer, for example, formed of a polyimide (PI) resin

Heat generating layer 732: an electrically conductive material layer, for example, formed of Ni, Ag, SUS Intermediate layer 733: an elastic layer for uniform fixation Release layer 734: a resin layer, for example, formed of a fluorine-containing resin material for obtaining releasing effect and making oilless.

The release layer 734 is preferably 10 μm to 300 μm in thickness, particularly preferably about 200 μm in thickness. In this manner, in the fixing device 70 as illustrated in FIG. 6, since the surface layer of the fixing belt 730 sufficiently covers a toner image T formed on a recording medium 770, it becomes possible to uniformly heat and melt the toner image T. The release layer 734; i.e., a surface release layer needs to have a thickness of 10 μm at minimum in order to secure abrasion resistance over time. In addition, when the release layer 734 exceeds 300 μm in thickness, the heat capacity of the fixing belt 730 comes to be larger, resulting in a longer warm-up time period. Further, additionally, a surface temperature of the fixing belt 730 hardly decreases in the toner-fixing step, a cohesion effect of melted toner at an outlet of the fixing portion cannot be obtained, and thus so-called hot offset occurs in which a releasing property of the fixing belt 730 is lowered, and toner particles of the toner image T is attached onto the fixing belt 730. Moreover, as a substrate of the fixing belt 730, the heat generating layer 732 formed of a metal may be used, or the resin layer having heat resistance, such as a fluorine-containing resin, a polyimide resin, a polyamide resin, a polyamide-imide resin, a PEEK resin, a PES resin, and a PPS resin, may be used.

The pressure roller 740 is formed of a cylindrical metal core 741 made of a metal having a high thermal conductivity, for example, copper or aluminum, and an elastic member 742 having a high heat resistance and toner releasing property that is located on the surface of the metal core 741. The metal core 741 may be made of SUS other than the above-described metals. The pressure roller 740 presses the fixing roller 720 through the fixing belt 730 to form a nip portion N. According to this embodiment, the pressure roller 740 is arranged to engage into the fixing roller 720 (and the fixing belt 730) by causing the hardness of the pressure roller 740 to be higher than that of the fixing roller 720, whereby the recording medium 770 is in conformity with the circumferential shape of the pressure roller 740, thus to provide the effect that the recording medium 770 is likely to come off the surface of the fixing belt 730. This pressure roller 740 is about 20 mm to about 40 mm in outer diameter which is the same as the fixing roller 720. This pressure roller 740, however, is about 0.5 mm to about 2.0 mm in thickness, to be thinner than the fixing roller 720.

The induction heating unit 760 for heating the heating roller 710 by electromagnetic induction, as illustrated in FIG. 6, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761 is the one in which one long exciting coil wire is wound alternately in an axial direction of the heating roller 710 along this coil guide plate 762. Further, in the exciting coil 761, an oscillation circuit is connected to a driving power source of variable frequencies. Outside of the exciting coil 761, an exciting coil core 763 of a semi-cylindrical shape that is made of a ferromagnetic material such as ferrites is fixed to an exciting coil core support 764 to be located in the proximity to the exciting coil 761.

(Process Cartridge)

Among the following units of an image forming apparatus 1: an electrophotographic photoconductor 3; a charging device 10 serving as a charging unit configured to charge the electrophotographic photoconductor; an exposing device 4 serving as an exposing unit configured to form a latent electrostatic image on the charged electrophotographic photoconductor 3; a developing device 40 serving as a developing unit configured to develop, with the above-described toner 100, the latent electrostatic image on the electrophotographic photoconductor 3 to form a toner image; a transfer device 50 serving as a transfer unit configured to transfer the toner image on the electrophotographic photoconductor 3 onto a recording medium 9 directly or via an intermediate transfer belt 51 serving as an intermediate transfer member; a fixing device 70 serving as a fixing unit configured to fix the transferred toner image on the recording medium 9 through application of heat and pressure; and a cleaning device 20 serving as a cleaning unit configured to remove the toner 100 on the surface of the electrophotographic photoconductor 3 from which the toner image has been transferred onto the intermediate transfer belt 51 or the recording medium 9, a process cartridge 2 of the present invention contains at least the electrophotographic photoconductor 3 and the above units including the developing unit which are integrally supported and is detachably mounted to the main body of the image forming apparatus. The developing device 40 contains the toner 100 of the present invention. The above-described developing device unit and charging unit may be suitably used as the developing unit and the charging unit, respectively.

Figure 8:
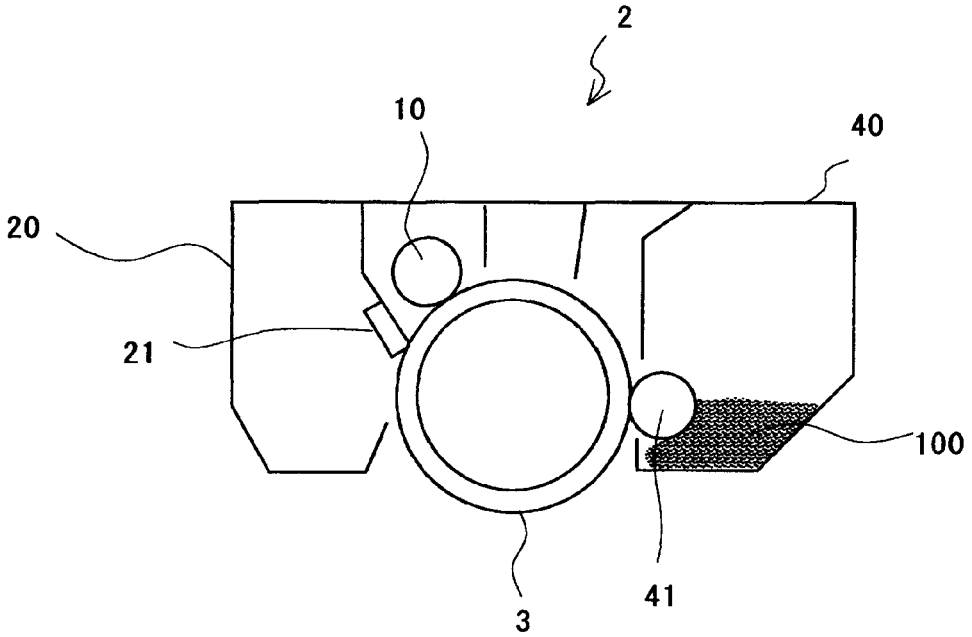
FIG. 8 is a schematic view of one exemplary process cartridge of the present invention.

FIG. 8 is a schematic view of an example of the process cartridge of the present invention. The process cartridge 2 illustrated in FIG. 8 includes a photoconductor 3, a charging device 10, a developing device 40, and a cleaning device 20.

In the operation of this process cartridge 2, the photoconductor 3 is rotated at a predetermined peripheral speed. In the course of rotating, the photoconductor 3 receives from the charging device 10 a uniform, positive or negative electrical charge of a specific potential around its periphery, and then receives image exposure light from an image exposing unit, such as slit exposure or laser beam scanning exposure, and in this way a latent electrostatic image is formed on the periphery of the photoconductor 3. The latent electrostatic image thus formed is then developed by a developing device 40, and the developed toner image is transferred onto a recording medium 9 that is fed from a paper supplier 60 to in between the photoconductor 3 and the transfer device 50, in synchronization with the rotation of the photoconductor 3. The recording medium onto which the image has been transferred is separated from the surface of the photoconductor 3, introduced into an unillustrated image fixing device 70 so as to fix the image thereon, and this product is printed out from the device as a copy or a print. The surface of the photoconductor 3 after the image transfer is cleaned by the cleaning device 20 so as to remove the toner remaining after the transfer, and is electrically neutralized and repeatedly used for image formation.

(Image Forming Apparatus)

Figure 9:
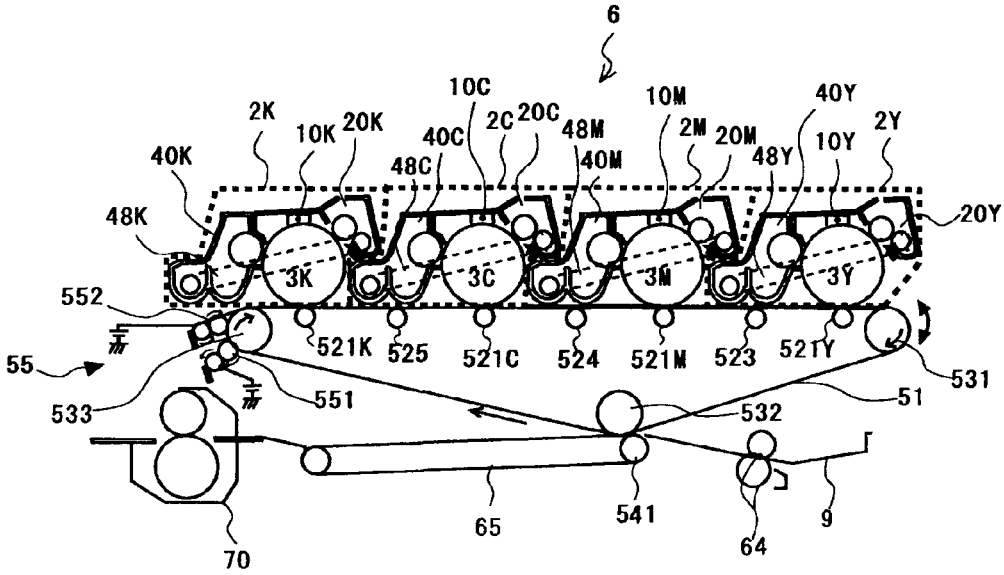
FIG. 9 is a schematic view of one exemplary image forming apparatus of the present invention.
Figure 10:
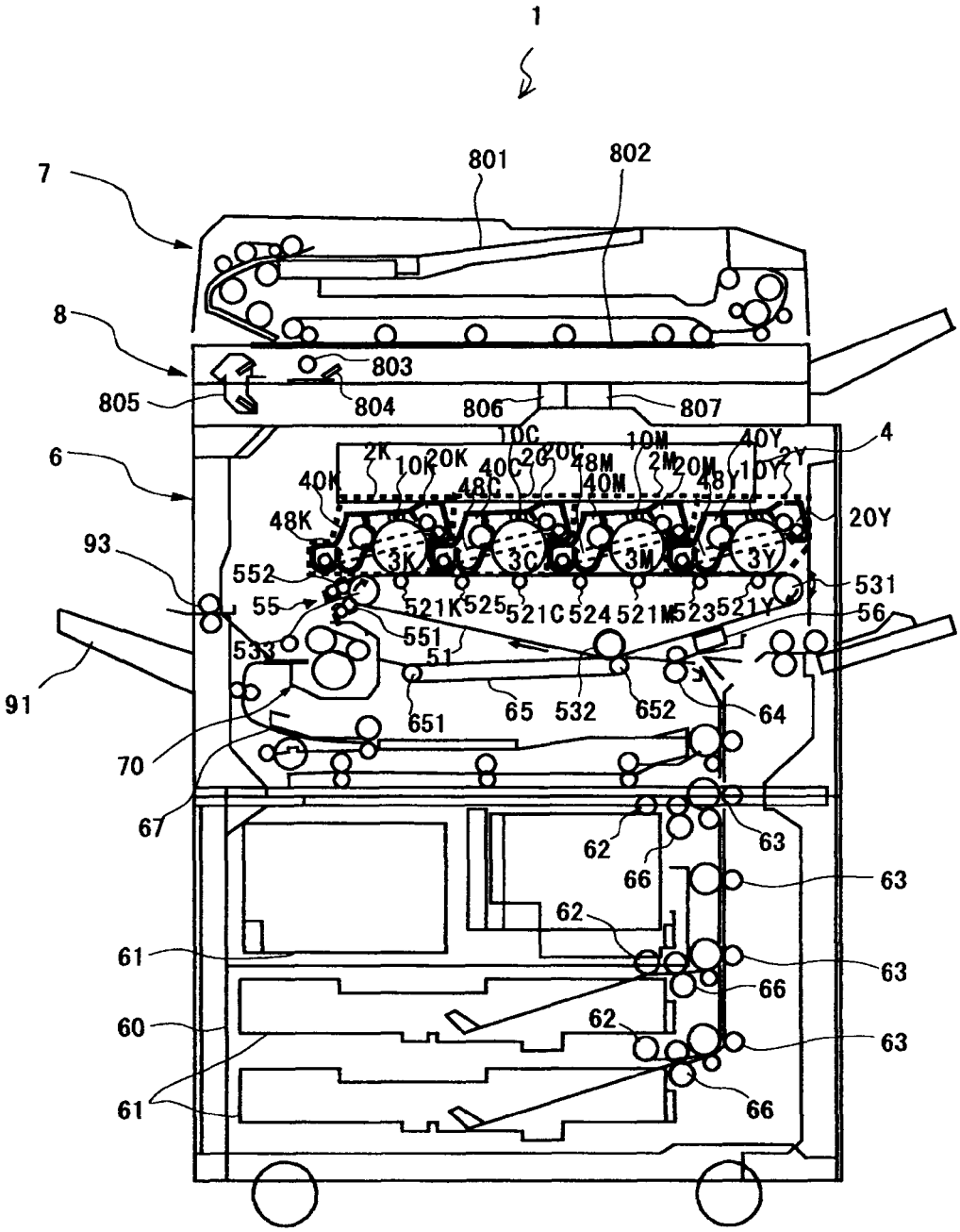
FIG. 10 is a schematic view of another exemplary image forming apparatus of the present invention.

For example, a tandem-type image forming apparatus 1 illustrated in FIGS. 9 and 10 may be used as the full-color image forming apparatus used in the full-color image forming method of the present invention. FIG. 9 is a schematic view of one exemplary image forming apparatus of the present invention. FIG. 10 is a schematic view of another exemplary image forming apparatus of the present invention.

In FIG. 9, the image forming apparatus 1 is composed mainly of an exposing device 4 for performing color image formation by an electrophotographic method, an image forming section 6, and a paper-feeding device 60 containing a paper feeding cassette 61.

According to image signals, image processing is performed in an image processing section for conversion to respective color signals of black (Bk), cyan (C), magenta (M), and yellow (Y) for image formation, and the color signals are sent to the exposing device 4 for writing images. The exposing device 4 is a laser scanning optical system that includes, for example, a laser beam source, a deflector such as a rotary polygon mirror, a scanning imaging optical system, and a group of mirrors, has four writing optical paths corresponding to the color signals, and performs image writing according to the color signals in the image forming section 6.

The image forming section 6 includes photoconductors 3K, 3C, 3M and 3Y respectively for black, cyan, magenta, and yellow. An OPC photoconductor is generally used for the photoconductors 3K, 3C, 3M and 3Y. For example, chargers 10K, 10C, 10M and 10Y, exposing portions for laser beams emitted from the exposing unit 4, developing devices 40K, 40C, 40M and 40Y for respective colors, primary transfer devices 52K, 52C, 52M and 52, cleaning devices 20K, 20C, 20M and 20Y), and charge-eliminating devices are provided around the respective photoconductors 3K, 3C, 3M and 3Y. The developing devices 40K, 40C, 40M and 40Y use a two-component magnetic brush development system. Further, an intermediate transfer belt 51 is interposed between the photoconductors 3K, 3C, 3M and 3Y and the primary transfer devices 52K, 52C, 52M and 52Y. Color toner images are successively transferred from respective photoconductors 3 onto the intermediate transfer belt 51 to bear the toner images formed on the photoconductors 3.

In some cases, a pre-transfer charger 56 is preferably provided as a pre-transfer charging unit at a position that is outside the intermediate transfer belt 51 and after the passage of the final color through a primary transfer position and before a secondary transfer position. Before the toner images on the intermediate transfer belt 51, which have been transferred from the photoconductors 3 in the primary transfer unit, are transferred onto a recording medium, the pre-transfer charger 56 charges toner images evenly to the same polarity.

The toner images on the intermediate transfer belt 51 transferred from the photoconductors 3K, 3C, 3M and 3Y include a halftone portion and a solid image portion or a portion in which the level of superimposition of toner 100 is different. Accordingly, in some cases, the charge amount varies from toner image to toner image. Further, due to separation discharge generated in spaces on an adjacent downstream side of the primary transfer unit in the direction of movement of the intermediate transfer belt, a variation in charge amount within toner images on the intermediate transfer belt 51 after the primary transfer sometimes occurs. The variation in charge amount within the same toner image disadvantageously lowers a transfer latitude in the secondary transfer unit that transfers the toner images on the intermediate transfer belt 56 onto the recording medium 9. Accordingly, the toner images before transfer onto the recording medium 9 are evenly charged to the same polarity by the pre-transfer charger to eliminate the variation in charge amount within the same toner image and to improve the transfer latitude in the secondary transfer unit.

Thus, according to the image forming method wherein the toner images located on the intermediate transfer belt 51 and transferred from the photoconductors 3K, 3C, 3M and 3Y are evenly charged by the pre-transfer charger 56, even when a variation in charge amount of the toner images located on the intermediate transfer belt 51 exists, the transfer properties in the secondary transfer unit can be rendered almost constant over each portion of the toner images located on the intermediate transfer belt 51. Accordingly, a lowering in the transfer latitude in the transfer of the toner images onto the transfer paper can be suppressed, and the toner images can be stably transferred.

In the image forming method, the amount of charge by the pre-transfer charger varies depending upon the moving speed of the intermediate transfer belt 51 as the charging object. For example, when the moving speed of the intermediate transfer belt 51 is low, the period of time, for which the same part in the toner images on the intermediate transfer belt 51 passes through a region of charging by the pre-transfer charger, increased. Therefore, in this case, the charge amount is increased. On the other hand, when the moving speed of the intermediate transfer belt 51 is high, the charge amount of the toner images on the intermediate transfer belt 51 is decreased. Accordingly, when the moving speed of the intermediate transfer belt 51 changes during the passage of the toner images on the intermediate transfer belt 51 through the position of charging by the pre-transfer charger, preferably, the pre-transfer charger is regulated according to the moving speed of the intermediate transfer belt 51 so that the charge amount of the toner images does not change during the passage of the toner images on the intermediate transfer belt 51 through the position of charging by the pre-transfer charger.

Electrically conductive rollers 523, 524 and 525 are provided between the primary transfer devices 52K, 52C, 52M and 52Y. The recording medium 9 is fed from a paper feeder 60 and then is supported on an intermediate transfer belt 51 through a pair of registration rollers 64. At a portion where the intermediate transfer belt 51 comes into contact with the transfer belt 65, the toner images on the intermediate transfer belt 51 are transferred by a secondary transfer roller 541 onto the recording medium 9 to perform color image formation.

The recording medium 9 after image formation is transferred by the transfer belt 65 to a fixing device 70 where the color image is fixed to provide a fixed color image. The toner remaining after transfer on the intermediate transfer belt 51 is removed form the belt by an intermediate transfer belt cleaning device 55.

The polarity of the toner on the intermediate transfer belt 51 before transfer onto the transfer paper has the same negative polarity as the polarity in the development. Accordingly, a positive transfer bias voltage is applied to the secondary transfer roller 541, and the toner 100 is transferred onto the recording medium 9. The nip pressure in this portion affects the transferability and significantly affects the fixability. The toner 100 remaining after transfer and located on the intermediate transfer belt 51 is subjected to discharge electrification to positive polarity side; i.e., 0 to positive polarity, in a moment of the separation of the transfer paper from the intermediate transfer belt 51. Toner images formed on the recording medium 9 in jam or toner images in a non-image region of the transfer paper are not influenced by the secondary transfer and thus, of course, maintain negative polarity.

The thickness of the photoconductor layer, the beam spot diameter of the optical system, and the quantity of light are 30 μm, 50 μm×60 μm, and 0.47 mW, respectively. The developing step is performed under such conditions that the charge (exposure side) potential V0 of the photoconductor (black) (3K) is −700 V, potential VL after exposure is −120 V, and the development bias voltage is −470 V, that is, the development potential is 350 V. The visual image of the toner (black) 100 formed on the photoconductor (black) (3K) is then subjected to transfer (intermediate transfer belt and recording medium) and the fixing step and consequently is completed as an image. Regarding the transfer, all the colors are first transferred from the primary transfer devices 52K, 52C, 52M and 52Y to the intermediate transfer belt 51 followed by transfer to the recording medium 9 by applying bias to a separate secondary transfer roller 541.

Next, the cleaning device 20 for the photoconductor 3 will be described in detail. In FIG. 9, the developing devices 40K, 40C, 40M and 40Y are connected to respective cleaning devices 40K, 40C, 40M and 40Y through toner transfer tubes 48K, 48C, 48M and 48Y (dashed lines in FIG. 8). A screw is provided within the toner transfer tubes 48K, 48C, 48M and 48Y, and the toners 100 recovered in the cleaning devices 20K, 20C, 20M and 20Y are transferred to the respective developing devices 40K, 40C, 40M and 40Y.

A direct transfer system including a combination of four photoconductors 3 with belt transfer has the following drawback. Specifically, upon abutting of the photoconductor 3 against the recording medium 9, paper dust is attached onto the photoconductor 3. Therefore, the toner 100 recovered from the photoconductor contains paper dust and thus cannot be used because, in the image formation, an image deterioration such as toner dropouts occurs. Further, in a conventional system including a combination of one photoconductor 3 with an intermediate transfer belt 51, the adoption of the intermediate transfer belt 51 has eliminated a problem of the adherence of paper dust onto the photoconductor 3 in the transfer onto the recording medium 9. In this system, however, when recycling of the residual toner 100 on the photoconductor 3 is contemplated, the separation of the mixed color toners 100 is practically impossible. The use of the mixed color toners 100 as a black toner 100 has been proposed. However, even when all the colors are mixed, a black color is not produced. Further, colors vary depending upon printing modes. Accordingly, in the construction using one photoconductor 3, recycling of the toner is impossible.

By contrast, in the full-color image forming apparatus 1, since the intermediate transfer belt 51 is used, the contamination with paper dust is not significant. Further, the adherence of paper dust onto the intermediate transfer belt 51 during the transfer onto the paper can also be prevented. Since each of the photoconductors 3K, 3C, 3M and 3Y uses independent respective color toners 100, there is no need to perform contacting and separating of the photoconductor cleaning devices 20K, 20C, 20M and 20Y. Accordingly, only the toner 100 can be reliably recovered.

The positively charged toner 100 remaining after transfer on the intermediate transfer belt 51 is removed by cleaning with an electrically conductive fur brush 552 to which a negative voltage has been applied. A voltage can be applied to the electrically conductive fur brush 552 in the same manner as in the application of the voltage to an electrically conductive fur brush 551, except that the polarity is different. The toner remaining after transfer can be almost completely removed by cleaning with the two electrically conductive fur brushes 551 and 552. The toner 100, paper dust, talc remaining unremoved by cleaning with the electrically conductive fur brush 552 are negatively charged by a negative voltage of the electrically conductive fur brush 552. The subsequent primary transfer of black is transfer by a positive voltage. Accordingly, the negatively charged toner 100 is attracted toward the intermediate transfer belt 51, and, thus, the transfer to the photoconductor (black) (3K) side can be prevented.

Next, the intermediate transfer belt 51 used in the image forming apparatus will be described. As described above, the intermediate transfer belt is preferably a resin layer having a single layer structure. If necessary, the intermediate transfer belt may have an elastic layer and a surface layer.

Examples of the resin materials constituting the resin layer include, but not limited to, polycarbonate resins, fluorine resins (such as ETFE and PVDF); polystyrenes, chloropolystyrenes, poly-α-methylstyrenes; styrene resins (homopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile-acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination.

Examples of elastic materials (elastic rubbers, elastomers) constituting the elastic layer include, but not limited to, butyl rubber, fluorine-containing rubber, acryl rubber, EPDM, NBR, acrylonitrile-butadiene-styrene natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, and thermoplastic elastomers (for example, polystyrene, polyolefin, polyvinyl chloride, polyurethane, polyamide, polyurea, polyester and fluorine resins). These rubbers may be used alone or in combination.

The material used for the surface layer is not particularly limited but is required to reduce the adhesion force of the toner 100 to the surface of the intermediate transfer belt so as to improve the secondary transfer property. The surface layer preferably contains one or two or more of polyurethane resin, polyester resin, and epoxy resin, and one or two or more of materials that reduce surface energy and enhance lubrication, for example, powders or particles such as fluorine resin, fluorine compound, carbon fluoride, titanium dioxide, and silicon carbide, or a dispersion of the materials having different particle diameters. In addition, it is possible to use a material such as fluorine rubber that is treated with heat so that a fluorine-rich layer is formed on the surface and the surface energy is reduced.

The resin layer and elastic layer preferably contain an electrically conductive agent for adjusting resistance. The electrically conductive agent for adjusting resistance is not particularly limited and may be appropriately selected depending on the intended purpose. Examples thereof include, but not limited to, carbon black, graphite, metal powders such as aluminum and nickel; electrically conductive metal oxides such as tin oxide, titanium oxide, antimony oxide, indium oxide, potassium titanate, antimony oxide-tin oxide composite oxide (ATO), and indium oxide-tine oxide composite oxide (ITO). The electrically conductive metal oxides may be coated with insulating fine particles such as barium sulfate, magnesium silicate, and calcium carbonate.

FIG. 10 shows another example of the image forming apparatus used in the full-color image forming method of the present invention and is an electrophotographic image forming apparatus 1 of a tandem indirect transfer system.

The image forming apparatus 1 includes a paper feeding device 60 for mounting the recording medium 9, a scanner 8, which is arranged over the device main body, and an automatic document feeder (ADF) 7, which is arranged over the scanner 8.

The image forming apparatus 1 has an endless belt intermediate transfer member 51 in the center thereof. As illustrated in FIG. 10, the intermediate transfer member is stretched around three support rollers 531, 532, and 533 and rotates clockwise. An intermediate transfer member cleaning device 55 for removing residual toner 100 on the intermediate transfer member 51 is provided on the left-hand side of the support roller 533 of the three support rollers. The tandem image forming apparatus 1 is composed of four process cartridges 2K, 2C, 2M and 2Y for yellow, cyan, magenta, and black (serving as image forming units) which face the intermediate transfer member 51 stretched around the support roller 531 and the support roller 532 and are arranged side by side in the transfer rotation direction thereof.

An exposing device 4 is provided over the tandem image forming device 1 as illustrated in FIG. 10. A second transfer device 54 is provided across the intermediate transfer belt 51 from the tandem image forming apparatus 1. The secondary transfer device 54 has an endless transfer belt 65 stretched around a pair of rollers 651 and 652, and is arranged so as to press against the support roller 652 via the intermediate transfer belt 51, thereby transferring an image carried on the intermediate transfer belt 51 onto a recording medium 51. A fixing device 70 configured to fix the transferred image on the recording medium 9 is provided near the second transfer device 54.

The fixing device 70 has an endless fixing belt 730 and a pressure roller 740 pressed against the fixing belt 730. The second transfer device 54 includes a recording medium 9 conveyance function in which the recording medium 9 onto which the image has been transferred is conveyed to the fixing device 70. As the second transfer device 54, a transfer roller or a non-contact charge may be provided, however, these are difficult to provide in conjunction with the recording medium 9 conveyance function. A sheet inversion device 67 for forming images on both sides of the recording medium 9 is provided parallel to the tandem image forming apparatus 1 and under the second transfer device 54 and fixing device 70.

Next will be described the image forming operation of the image forming apparatus 1.

At first, a document is placed on a document table 801 of the automatic document feeder 7, when a copy is made using the full-color image forming apparatus 1. Alternatively, the automatic document feeder 7 is opened, the document is placed onto a contact glass 802 of the scanner 8, and the automatic document feeder 7 is closed.

When an unillustrated start switch is pressed, a document placed on the automatic document feeder 7 is conveyed onto the contact glass 801. When the document is initially placed on the contact glass 802, the scanner 8 is immediately driven to operate a first carriage 804 and a second carriage 805. At the first carriage 804, light is applied from a light source to the document, and reflected light from the document is further reflected toward the second carriage 805. The reflected light is further reflected by a mirror of the second carriage 805 and passes through image-forming lens 806 into a read sensor CCD 807 to thereby read the document.

When the start switch is pressed, one of the support rollers 531, 532 and 533 is rotated by a drive motor, and as a result, the other two support rollers are rotated by the rotation of the driven support roller. In this way, the intermediate transfer belt 51 runs around the support rollers. Simultaneously, the individual image forming units 6 respectively rotate their photoconductors 3 to thereby form black, yellow, magenta, and cyan monochrome images on the photoconductors 3 respectively. With the conveyance of the intermediate transfer belt 51, the monochrome images are sequentially transferred to form a composite color image on the intermediate transfer belt 51.

Separately, when the start switch is pressed, one of paper feeding rollers 62 of the paper feeding cassette 61 is selectively rotated, recording media 9 are discharged from one of multiple feeder cassettes 61 in a paper feeding device 60 and are separated in a separation roller 66 one by one into a feeder path, are transferred by a transfer roller 63 into a feeder path in the image forming apparatus 1 and are bumped against registration rollers 64.

Alternatively, rotating the paper feeding roller 62 to discharge the recoding media 9 on a manual tray, and the recoding media 9 are separated one by one with a separation roller 66 into a manual feeder path and are bumped against the registration rollers 64.

The registration rollers 64 are rotated synchronously with the movement of the composite color image on the intermediate transfer belt 51 to transfer the recording medium 9 into between the intermediate transfer belt 51 and the secondary transfer device 54, and the composite color image is transferred onto the recording medium 9 by the action of the secondary transfer device 54 to thereby form a color image on the recording medium 9.

The recording medium 9 onto which the image has been transferred is conveyed by the secondary transfer device 54 into the fixing device 70, is given heat and pressure in the fixing device 70 to fix the transferred image, changes its direction with a switch claw, and is discharged by a discharge roller 93 to be stacked on an output tray 91. Alternatively, the moving direction of the paper is changed by the switching claw, and the paper is conveyed to the sheet inversion device 93 where it is inverted, and guided again to the transfer position in order that an image is formed also on the back surface thereof, then the paper is discharged by the discharge roller 93 and stacked on the output tray 91.

On the other hand, in the intermediate transfer belt 51 after the image transfer, the toner 100, which remains on the intermediate transfer belt 51 after the image transfer, is removed by the intermediate transfer member cleaning device 55, and the intermediate transfer member 51 again gets ready for image formation by the tandem image forming apparatus 1. The registration rollers 64 are generally used in a grounded state. Bias may also be applied to the registration rollers 64 to remove paper dust of the recording medium 9.

EXAMPLES

The present invention will next be described in more detail by way of Examples and Comparative Examples. The present invention is not construed as being limited to Examples and Comparative Examples. Unless otherwise specified, the unit "part(s)" in Examples means "part(s) by mass."

Example 1

<Preparation of Solution or Dispersion Liquid of Toner Materials>

—Synthesis of Phenol Multimer A1—

There was synthesized phenol multimer A1 represented by the General Formula (1) where n is 3 to 4, $R^2$, $R^{12}$ and $R^{22}$ each are a chlorine atom, and the other Rs each are a hydrogen atom.

First, p-chlorophenol (0.18 mol) and p-formaldehyde (0.10 mol) were refluxed for 15 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Synthesis of Unmodified Polyester (Low-molecular-weight Polyester)—

Into a reaction vessel equipped with a condenser, a stirrer, and a nitrogen-introducing tube, 67 parts of bisphenol A ethyleneoxide (2 mol) adduct, 84 parts of bisphenol A propionoxide (3 mol) adduct, 274 parts of terephthalic acid, and 2 parts of dibutyltin oxide were charged, allowing the resultant mixture to react for 8 hours at 230° C. under normal pressure. Subsequently, the reaction mixture was allowed to react for 5 hours under reduced pressure of 1,333 Pa to 2,000 Pa (10 mmHg to 15 mmHg), to thereby synthesize an unmodified polyester. The thus-obtained unmodified polyester had a number average molecular weight (Mn) of 2,100, a weight average molecular weight (Mw) of 5,600, and a glass transition temperature (Tg) of 55° C.

—Preparation of Master Batch (MB)—

1,000 parts of water, 540 parts of carbon black (Printex 35; product of Degussa; DBP oil absorption amount: 42 mL/100 g; pH 9.5), and 1,200 parts of the unmodified polyester were mixed by means of HENSCHEL MIXER (product of Mitsui Mining Co., Ltd.). The resultant mixture was kneaded at 150° C. for 30 min by a two-roller mill, cold-rolled, and pulverized by a pulverizer (product of Hosokawa micron Co., Ltd.), to thereby prepare a master batch.

—Synthesis of Prepolymer—

Into a reaction vessel equipped with a condenser, a stirrer, and a nitrogen-introducing tube, 682 parts of bisphenol A ethyleneoxide (2 mol) adduct, 81 parts of bisphenol A propyleneoxide (2 mol) adduct, 283 parts of terephthalic acid, 22 parts of trimellitic anhydride, and 2 parts of dibutyltin oxide were charged, allowing the resultant mixture to react for 8 hours at 230° C. under normal pressure. Subsequently, the reaction mixture was allowed to react for 5 hours under reduced pressure of 1,333 Pa to 2,000 Pa (10 mmHg to 15 mmHg), to thereby synthesize an intermediate polyester. The thus-obtained intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl group value of 49 mgKOH/g.

Subsequently, into a reaction vessel equipped with a condenser, a stirrer, and a nitrogen-introduging tube, 411 parts of the intermediate polyester, 89 parts of isophorone diisocyanate, and 500 parts of ethyl acetate were charged, allowing the resultant mixture to react for 5 hours at 100° C. to thereby synthesize a prepolymer (i.e., the above-described polymer reactive with an active hydrogen group-containing compound). The prepolymer thus obtained had a free isocyanate content of 1.60% and solid content concentration of 50% (150° C., after being left for 45 min).

<Preparation of Fine Resin Particles>

Into a reaction vessel equipped with a stirring rod and a thermometer, 683 parts of water, 16 parts of sodium salt of sulfuric acid ester of ethylene oxide adduct of methacrylic acid (Eleminol RS-30, product of Sanyo Chemical Industries Ltd.), 83 parts of styrene, 83 parts of methacrylic acid, 110 parts of butyl acrylate, and 1 part of ammonium persulfate were charged, and then stirred at 400 rpm for 15 min to thereby obtain a white emulsion. The emulsion was heated to a system temperature of 75° C. and was allowed to react for 5 hours. Then, 30 parts of a 1% by mass aqueous ammonium persulfate solution was added to the emulsion, followed by aging at 75° C. for 5 hours, to thereby obtain an aqueous dispersion [fine resin particle dispersion liquid A] of a vinyl resin (a copolymer of styrene-methacrylic acid-butyl acrylate-sodium salt of sulfate ester of methacrylic acid-ethylene oxide adduct). The volume average particle diameter of the [fine resin particle dispersion liquid A] was found to be 42 nm, when measured using a particle size distribution analyzer (LA-920, product of Horiba, Ltd.).

<Production of Toner a>

<<Solution or Dispersion Liquid-preparing Step>>

—Preparation of Phenol Multimer A1 Dispersion Liquid—

The phenol multimer A1 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 3, to thereby produce a phenol multimer A1 dispersion liquid. The average particle diameter (average dispersion diameter) of the phenol multimer A1 contained in the dispersion liquid was found to be 120 nm.

—Preparation of Toner Material Phase—

The unmodified polyester (100 parts) and ethyl acetate (130 parts) were added to a beaker, followed by dissolving with stirring. Then, carnauba wax (molecular weight=1,800, acid value=2.5, penetration degree=1.5 mm (40° C.)) (10 parts), the masterbatch (10 parts) and the phenol multimer A1 dispersion liquid (1 part) were charged into the beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 3, to thereby produce a raw material solution. Furthermore, the prepolymer (40 parts by mass) was added thereto, followed by stirring, to thereby prepare a solution or dispersion liquid of the toner material (toner material phase).

<<Emulsion or Dispersion Liquid-preparing Step>>

—Preparation of Aqueous Medium Phase—

Water (660 parts), the fine resin particle dispersion liquid A (1.25 parts), 25 parts of 48.5% by mass aqueous solution of sodium dodecyldiphenyl ether disulfonate (Eleminol MON-7, product of Sanyo Chemical Industries Ltd.) and ethyl acetate (60 parts) were mixed together to obtain a milky white liquid (aqueous medium phase).

—Preparation of Emulsion or Dispersion Liquid A—

The aqueous medium phase (150 parts) was placed in a container, and then stirred at 12,000 rpm with a TK homomixer (product of Tokushu Kika Kogyo Co., Ltd.). Subsequently, the solution or dispersion liquid of the toner material (100 parts) was added to the thus-treated aqueous medium phase, and the resultant mixture was mixed for 10 min to thereby prepare emulsion or dispersion liquid A (emulsified slurry).

<<Organic Solvent-Removing Step>>

—Removal of Organic Solvent—

A flask equipped with a degassing tube, a stirrer, and a thermometer was charged with 100 parts of the emulsion or dispersion liquid A. The solvent was removed by stirring the emulsified slurry under conditions of stirring circumferential velocity of 20 m/min at 30° C. for 12 hours under reduced pressure to give desolvated slurry A.

—Washing/drying—

The whole amount of the desolvated slurry A was filtrated under reduced pressure. Then, 300 parts of ion-exchanged water was added to the filtration cake, followed by mixing and redispersing with a TK homomixer (product of Tokushu Kika Kogyo Co., Ltd.) (12,000 rpm for 10 min) and filtrating. Furthermore, 300 parts of ion-exchanged water was added to the filtration cake, followed by mixing with a TK homomixer (product of Tokushu Kika Kogyo Co., Ltd.) (12,000 rpm for 10 min) and filtrating. This mixing/filtrating procedure was performed three times. The filtration cake thus obtained was dried in a downwind drier at 45° C. for 48 hr. The dried product was sieved through a sieve with 75 μm-mesh opening to give toner base particles a.

—External Addition Treatment—

Using a HENSCHEL MIXER, the toner base particles a (100 parts) was mixed with 0.6 parts of hydrophobic silica having an average particle diameter of 100 nm, 1.0 part of titanium oxide having an average particle diameter of 20 nm, and 0.8 parts of a fine powder of hydrophobic silica having an average particle diameter of 15 nm, to thereby give toner a.

Example 2

<Production of Toner b>

The procedure of Example 1 was repeated, except that the phenol multimer A1 having an average dispersion diameter of 120 nm was changed to phenol multimer A1 having an average dispersion diameter of 70 nm, to thereby produce toner b.

A dispersion liquid of the phenol multimer A1 having an average dispersion diameter of 70 nm was prepared as follows.

—Preparation of Phenol Multimer A1 Dispersion Liquid—

The phenol multimer A1 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 5, to thereby produce the phenol multimer A1 dispersion liquid.

Example 3

—Production of Toner c—

The procedure of Example 1 was repeated, except that the phenol multimer A1 having an average dispersion diameter of 120 nm was changed to phenol multimer A1 having an average dispersion diameter of 300 nm, to thereby produce toner c.

A dispersion liquid of the phenol multimer A1 having an average dispersion diameter of 300 nm was prepared as follows.

—Preparation of Phenol Multimer A1 Dispersion Liquid—

The phenol multimer A1 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 2, to thereby produce the phenol multimer A1 dispersion liquid.

Example 4

<Production of Toner d>

The procedure of Example 1 was repeated, except that the phenol multimer A1 was changed to phenol multimer A2, to thereby produce toner d.

In the following manner, the phenol multimer A2 was synthesized and its dispersion liquid was prepared.

—Synthesis of Phenol Multimer A2—

There was synthesized phenol multimer A2 represented by the General Formula (1) where n is 7 to 8, $R^2$, $R^{12}$ and $R^{22}$ each are a chlorine atom, and the other Rs each are a hydrogen atom.

First, p-chlorophenol (0.18 mol) and p-formaldehyde (0.10 mol) were refluxed for 40 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A2 Dispersion Liquid—

The phenol multimer A2 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A2 dispersion liquid. The average dispersion diameter of the phenol multimer A2 was found to be 45 nm.

Example 5

<Production of Toner e>

The procedure of Example 1 was repeated, except that the phenol multimer A1 was changed to phenol multimer A3, to thereby produce toner e.

In the following manner, the phenol multimer A3 was synthesized and its dispersion liquid was prepared.

—Synthesis of Phenol Multimer A3—

There was synthesized phenol multimer A3 represented by the General Formula (1) where n is 18 to 19, $R^2$, $R^{12}$ and $R^{22}$ each are a chlorine atom, and the other Rs each are a hydrogen atom.

First, p-chlorophenol (0.18 mol) and p-formaldehyde (0.10 mol) were refluxed for 2 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

Preparation of Phenol Multimer A3 Dispersion Liquid

The phenol multimer A3 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A3 dispersion liquid. The average dispersion diameter of the phenol multimer A3 was found to be 45 nm.

Example 6

<Production of Toner f>

The procedure of Example 1 was repeated, except that the phenol multimer A1 was changed to phenol multimer A4, to thereby produce toner f.

In the following manner, the phenol multimer A4 was synthesized and its dispersion liquid was prepared.

—Synthesis of Phenol Multimer A4—

There was synthesized phenol multimer A4 represented by the General Formula (1) where n is 10 to 11, $R^2$, $R^{12}$ and $R^{22}$ each are a chlorine atom, and the other Rs each are a hydrogen atom.

First, p-chlorophenol (0.18 mol) and p-formaldehyde (0.10 mol) were refluxed for 1 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A4 Dispersion Liquid—

The phenol multimer A4 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 4, to thereby produce a phenol multimer A4 dispersion liquid. The average dispersion diameter of the phenol multimer A4 was found to be 100 nm.

Example 7

<Production of Toner g>

The procedure of Example 1 was repeated, except that the phenol multimer A1 was changed to phenol multimer A5, to thereby produce toner f. In the following manner, the phenol multimer A5 was synthesized and its dispersion liquid was prepared.

—Synthesis of Phenol Multimer A5—

There was synthesized phenol multimer A5 represented by the General Formula (1) where n is 7 to 8, $R^2$, $R^{12}$ and $R^{22}$ each are a phenyl group, and the other Rs each are a hydrogen atom.

First, p-phenylphenol (0.18 mol) and p-formaldehyde (0.10 mol) were refluxed for 40 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A5 Dispersion Liquid—

The phenol multimer A5 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A5 dispersion liquid. The average dispersion diameter of the phenol multimer A5 was found to be 40 nm.

Example 8

<Production of Toner h>

The procedure of Example 1 was repeated, except that the phenol multimer A1 was changed to phenol multimer A6, to thereby produce toner f. In the following manner, the phenol multimer A6 was synthesized and its dispersion liquid was prepared.

—Synthesis of Phenol Multimer A6—

There was synthesized phenol multimer A6 represented by the General Formula (1) where n is 10 to 11, $R^2$, $R^{12}$ and $R^{22}$ each are a tert-butyl group, and the other Rs each are a hydrogen atom.

First, p-tert-butylphenol (0.18 mol) and p-formaldehyde (0.10 mol) were refluxed for 50 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A6 Dispersion Liquid—

The phenol multimer A6 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A6 dispersion liquid. The average dispersion diameter of the phenol multimer A6 was found to be 37 nm.

Example 9

<Production of Toner i>

The procedure of Example 1 was repeated, except that the phenol multimer A1 was changed to phenol multimer A7, to thereby produce toner i.

In the following manner, the phenol multimer A7 was synthesized and its dispersion liquid was prepared.

—Synthesis of Phenol Multimer A7—

There was synthesized phenol multimer A7 represented by the General Formula (1) where n is 16 to 17, $R^2$, $R^{12}$ and $R^{22}$ each are an isopropyl group, and the other Rs each are a hydrogen atom.

First, p-isopropylphenol (0.18 mol) and p-formaldehyde (0.10 mol) were refluxed for 1 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A7 Dispersion Liquid—

The phenol multimer A7 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A6 dispersion liquid. The average dispersion diameter of the phenol multimer A6 was found to be 31 nm.

Example 10

<Production of Toner j>

The procedure of Example 1 was repeated, except that the phenol multimer A1 was changed to phenol multimer A8, to thereby produce toner i.

In the following manner, the phenol multimer A8 was synthesized and its dispersion liquid was prepared.

—Synthesis of Phenol Multimer A8—

There was synthesized phenol multimer A8 represented by the General Formula (1) where n is 8 to 9, $R^2$, $R^{12}$ and $R^{22}$ each are a phenyl group or a tert-butyl group (where the ratio between these groups was 1:1), and the other Rs each are a hydrogen atom.

First, p-phenylphenol (0.09 mol), p-tert-butylphenyl (0.09 mol) and p-formaldehyde (0.10 mol) were refluxed for 30 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A8 Dispersion Liquid—

The phenol multimer A8 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A8 dispersion liquid. The average dispersion diameter of the phenol multimer A8 was found to be 44 nm.

Example 11

<Production of Toner k>

The procedure of Example 1 was repeated, except that the phenol multimer A1 was changed to phenol multimer A9, to thereby produce toner k.

In the following manner, the phenol multimer A9 was synthesized and its dispersion liquid was prepared.

—Synthesis of Phenol Multimer A9—

There was synthesized phenol multimer A9 represented by the General Formula (1) where n is 12 to 13, $R^2$, $R^{12}$ and $R^{22}$ each are a methyl group, and the other Rs each are a hydrogen atom.

First, p-methylphenol (0.18 mol) and p-formaldehyde (0.10 mol) were refluxed for 1 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A9 Dispersion Liquid—

The phenol multimer A9 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A9 dispersion liquid. The average dispersion diameter of the phenol multimer A9 was found to be 42 nm.

Example 12

<Production of Toner l>

The procedure of Example 1 was repeated, except that the phenol multimer A1 was changed to phenol multimer A10, to thereby produce toner l.

In the following manner, the phenol multimer A10 was synthesized and its dispersion liquid was prepared.

—Synthesis of Phenol Multimer A10—

There was synthesized phenol multimer A9 represented by the General Formula (1) where n is 11 to 12, $R^2$, $R^{12}$ and $R^{22}$ each are a chlorine atom, $R^5$, $R^{15}$ and $R^{25}$ each are a methyl group, and the other Rs each are a hydrogen atom.

First, 2-methyl-3 chlorophenol (0.18 mol) and p-formaldehyde (0.10 mol) were refluxed for 1 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A10 Dispersion Liquid—

The phenol multimer A10 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A10 dispersion liquid. The average dispersion diameter of the phenol multimer A10 was found to be 39 nm.

Example 13

<Production of Toner m>

The procedure of Example 1 was repeated, except that the phenol multimer A1 was changed to phenol multimer A11, to thereby produce toner m.

In the following manner, the phenol multimer A11 was synthesized and its dispersion liquid was prepared.

—Synthesis of Phenol Multimer A11—

There was synthesized phenol multimer A11 represented by the General Formula (1) where n is 5 to 6, $R^2$, $R^{12}$ and $R^{22}$ each are a chlorine atom, $R^4$, $R^5$, $R^{14}$, $R^{15}$, $R^{24}$ and $R^{25}$ each are a methyl group, and the other Rs each are a hydrogen atom.

First, 1,3-dimethyl-2-chlorophenol (0.18 mol) and p-formaldehyde (0.10 mol) were refluxed for 30 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A11 Dispersion Liquid—

The phenol multimer A11 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A11 dispersion liquid. The average dispersion diameter of the phenol multimer A11 was found to be 46 nm.

Example 14

<Production of Toner n>

The procedure of Example 1 was repeated, except that the phenol multimer A1 was changed to phenol multimer A12, to thereby produce toner n.

In the following manner, the phenol multimer A12 was synthesized and its dispersion liquid was prepared.

—Synthesis of Phenol Multimer A12—

There was synthesized phenol multimer A12 represented by the General Formula (1) where n is 6 or greater, $R^2$, $R^{12}$ and $R^{22}$ each are a p-bromophenyl group, and the other Rs each are a hydrogen atom.

First, p-bromophenylphenol (0.18 mol) and p-formaldehyde (0.10 mol) were refluxed for 1 hr in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A12 Dispersion Liquid—

The phenol multimer A12 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 6, to thereby produce a phenol multimer A12 dispersion liquid. The average dispersion diameter of the phenol multimer A12 was found to be 42 nm.

Example 15

<Production of Toner o>

The procedure of Example 1 was repeated, except that the phenol multimer A1 was changed to phenol multimer A13, to thereby produce toner o.

In the following manner, the phenol multimer A13 was synthesized and its dispersion liquid was prepared.

—Synthesis of Phenol Multimer A13—

There was synthesized phenol multimer A13 represented by the General Formula (1) where n is 1, $R^2$, $R^{12}$ and $R^{22}$ each are a chlorine atom, and the other Rs each are a hydrogen atom.

First, p-chlorophenol (0.18 mol) and p-formaldehyde (0.10 mol) were refluxed for 1 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A13 Dispersion Liquid—

The phenol multimer A13 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged:

80% by volume; and pass time: 3, to thereby produce a phenol multimer A13 dispersion liquid where the phenol multimer dissolved in ethyl acetate.

Example 16

<Production of Toner p>

The procedure of Example 1 was repeated, except that the phenol multimer A1 was changed to phenol multimer A14, to thereby produce toner p. In the following manner, the phenol multimer A14 was synthesized and its dispersion liquid was prepared.

—Synthesis of Phenol Multimer A14—

There was synthesized phenol multimer A14 represented by the General Formula (1) where n is 5 to 6, $R^2$, $R^{12}$ and $R^{22}$ each are a fluorine atom, and the other Rs each are a hydrogen atom.

First, p-fluorophenol (0.18 mol) and p-formaldehyde (0.10 mol) were refluxed for 30 min in xylene using potassium hydroxide (0.004 mol) for dehydration, followed by cooling and filtrating to obtain precipitates. The obtained precipitates were washed sequentially with toluene, ether, acetone and water, and then dried. Next, the dry product was recrystallized from chloroform to obtain white needle crystals.

—Preparation of Phenol Multimer A14 Dispersion Liquid—

The phenol multimer A14 (5 parts), the above unmodified polyester (15 parts) and ethyl acetate (30 parts) were charged into a beaker. The resultant mixture was treated with a bead mill (Ultra Viscomill, product of AIMEX CO., Ltd.) under the conditions: liquid-feeding rate: 1 kg/hr; disc circumferential speed: 6 m/sec; amount of 0.5 mm-zirconia beads charged: 80% by volume; and pass time: 5, to thereby produce a phenol multimer A14 dispersion liquid where the phenol multimer dissolved in ethyl acetate.

Comparative Example 1

<Production of Toner q>

The procedure of Example 1 was repeated, except that the phenol multimer A1 was changed to a zirconium salicylate complex (TN-105, product of Hodogaya Chemical Co.), to thereby produce toner q.

Comparative Example 2

<Production of Toner r>

The procedure of Example 1 was repeated, except that the phenol multimer A1 was changed to a zinc salicylate complex (E-84, product of ORIENT CHEMICAL INDUSTRIES CO., LTD), to thereby produce toner r.

Next, each of the toners of Examples 1 to 16 and Comparative Examples 1 and 2 was measured for properties in the following manner. The results are shown in Table 1.

<Volume Average Particle Diameter and Volume Average Particle Diameter/number Average Particle Diameter>

The volume average particle diameter (Dv) and volume average particle diameter/number average particle diameter (Dv/Dn) were measured with a particle size analyzer (Multisizer III, product of Beckman Coulter Co.).

<Average Circularity>

Into a 100 mL glass beaker, 0.1 mL to 0.5 mL of a 10% by mass surfactant (NEOGEN SC-A, which is an alkylbenzene sulfonate, product of Dai-ichi Kogyo Seiyaku Co., Ltd.) was added, 0.1 g to 0.5 g of the toner was added, the ingredients were stirred using a microspatula, then 80 mL of ion-exchanged water was added. The obtained dispersion liquid was subjected to dispersion treatment for 3 min using an ultrasonic wave dispersing device (product of Honda Electronics Co.). After the dispersion liquid had been adjusted to have a concentration of 5,000 (number per μL) to 15,000 (number per μL), the shape and distribution of the toner particles were measured using a flow-type particle image analyzer (FPIA-2100, product of Sysmex Co.).

<BET Specific Surface Area>

According to the BET method, the BET specific surface area of the toner particles was measured with a specific surface area measuring device (TRISTAR 3000, product of SHIMADZU CORPORATION). Specifically, nitrogen gas was adsorbed on the surface of each toner particle, and the specific surface area was measured with the multi point BET method.

TABLE 1

| | Toner | Dv/μm | Dv/Dn | Circularity | BET specific surface are/ $m^2 \cdot g^{-1}$ | Volume specific resistance/ Ωcm |
|---|---|---|---|---|---|---|
| Ex. 1 | a | 5.1 | 1.13 | 0.966 | 2.0 | 11.1 |
| Ex. 2 | b | 5.1 | 1.14 | 0.965 | 1.8 | 11.0 |
| Ex. 3 | c | 5.0 | 1.16 | 0.964 | 2.1 | 11.1 |
| Ex. 4 | d | 5.0 | 1.12 | 0.967 | 1.9 | 11.2 |
| Ex. 5 | e | 5.1 | 1.13 | 0.966 | 1.9 | 11.1 |
| Ex. 6 | f | 5.1 | 1.13 | 0.966 | 2.0 | 11.2 |
| Ex. 7 | g | 4.9 | 1.13 | 0.966 | 1.9 | 11.0 |
| Ex. 8 | h | 5.0 | 1.12 | 0.964 | 1.9 | 11.1 |
| Ex. 9 | i | 5.2 | 1.11 | 0.963 | 1.9 | 11.1 |
| Ex. 10 | j | 5.2 | 1.12 | 0.963 | 2.0 | 11.2 |
| Ex. 11 | k | 5.1 | 1.12 | 0.965 | 2.1 | 11.1 |
| Ex. 12 | l | 5.2 | 1.11 | 0.964 | 1.7 | 11.2 |
| Ex. 13 | m | 5.0 | 1.13 | 0.967 | 1.8 | 11.0 |
| Ex. 14 | n | 5.3 | 1.12 | 0.966 | 2.1 | 11.2 |
| Ex. 15 | o | 5.0 | 1.12 | 0.969 | 2.2 | 11.1 |
| Ex. 16 | p | 5.2 | 1.11 | 0.965 | 2.0 | 11.2 |
| Comp. Ex. 1 | q | 7.6 | 1.26 | 0.962 | 4.1 | 11.0 |
| Comp. Ex. 2 | r | Unable to be formed into toner | — | — | — | — |

[Production of Carrier]

Next, description will be given to the production example of a carrier used for the evaluation of each toner in an actual image forming apparatus. The carrier usable in the present invention is not limited thereto.

—Carrier—

Acrylic resin solution (solid content: 50% by mass): 21.0 parts

Guanamine solution (solid content: 70% by mass): 6.4 parts

Alumina particles [0.3 μm, volume specific resistance: $10^{14}$ (Ω·cm)]: 7.6 parts Silicone resin solution: 65.0 parts

[solid content: 23% by mass (SR2410: product of Dow Corning Toray Silicone Co., Ltd.)]

Aminosilane: 1.0 part

[solid content: 100% by mass (SH6020: product of Dow Corning Toray Silicone Co., Ltd.)]

Toluene: 60 parts

Butyl cellosolve: 60 parts

The materials for the carrier were dispersed with a homomixer for 10 min to give a coating film-forming solution of the acrylic resin and the silicone resin containing the alumina particles. The coating film-forming solution was applied onto the surface of fired ferrite powder [$(MgO)_{1.8}(MnO)_{49.5}(Fe_2O_3)_{48.0}$: average particle diameter: 25 μm] serving as a core material so as to have a thickness of 0.15 μm with SPILA COATER (product of OKADA SEIKO CO., LTD.), followed by drying, to thereby give coated ferrite powder. The coated ferrite powder was allowed to stand in an electric furnace at 150° C. for one hour for firing. After cooling, the ferrite powder bulk was disintegrated with a sieve having an opening of 106 μm to give a carrier.

Since the coating film covering the surface of the carrier could be observed by observing the cross-section of the carrier under a transmission electron microscope, the average of the film thickness was determined as the film thickness of the coating film. The obtained carrier was found to have a weight average particle diameter of 35 μm.

[Preparation of Two-component Developer]

The carrier (100 parts by mass) was homogeneously mixed with each (7 parts) of the toners a to r using a tubular mixer including a container that was tumbled for stirring, to thereby produce two-component developers a to r.

[Evaluation of Toner]

(Durability)

An evaluation machine, which was a modified machine of a digital full-color copier (DOCUCOLOR 8000 DIGITAL PRESS, product of Fuji Xerox Co., Ltd.) and subjected to tuning so that the linear velocity and the transfer time could be adjusted, was provided. Each developer was subjected to a 100,000-sheet running test with the evaluation machine in which a solid image pattern of size A4 at a toner coverage of 0.6 mg/cm$^2$ was output as a test pattern. Every 1,000-sheet running, the toner was sampled and measured for charge amount with the blow-off method as an index of durability. The initial charge amount of the toner was compared with the post-running charge amount to evaluate durability according to the following criteria.

A: The charge amount decreased was lower than 3 μC/g

B: The charge amount decreased was 3 μC/g or higher but lower than 5 μC/g

C: The charge amount decreased was 5 μC/g or higher but lower than 10 μC/g

D: The charge amount decreased was 10 μC/g or higher

<Charging Stability to Environment>

Using a digital full-color copier (IMAGIOCOLOR2800, product of Ricoh Company, Ltd.), the toner was sampled every 1,000-sheet running during outputting of 100,000 sheets of an image chart having an image occupation rate of 7% at a monochromatic mode. The thus-sampled toner was measured for charge amount with the blow-off method and evaluated for charging stability according to the following criteria. The evaluation of the charging stability under normal-temperature, normal-humidity environment was performed at 25° C. and 40% RH. The evaluation of the charging stability under high-temperature, high-humidity environment was performed at 40° C. and 90% RH. The evaluation of the charging stability under low-temperature, low-humidity environment was performed at 10° C. and 15% RH.

A: The charge amount changed was lower than 3 μC/g.

B: The charge amount changed was 3 μC/g or higher but lower than 5 μC/g.

C: The charge amount changed was 5 μC/g or higher but lower than 10 μC/g.

D: The charge amount changed was 10 μC/g or higher.

<Granularity>

Each of the toner a to r was measured for volume average particle diameter (Dv) and volume average particle diameter/number average particle diameter (Dv/Dn) with a particle size analyzer ("Multisizer III," product of Beckman Coulter Co.). The Dv was evaluated on the basis of the value 5.2 μm, and also, the Dv/Dn was evaluated. The evaluation criteria of the Dv are as follows.

A: Dv was 5.2 μm±0.1 μm (exclusive)

B: Dv was 5.2 μm±0.1 μm (inclusive) to 0.3 μm (exclusive)

C: Dv was 5.2 μm±0.3 μm (inclusive) to 0.5 μm (exclusive)

D: Dv was 5.2 μm±0.5 μm (inclusive)

Also, the evaluation criteria of the Dv/Dn are as follows.

A: Dv/Dn<1.15

B: 1.15≤Dv/Dn<1.17

C: 1.17≤Dv/Dn<1.25

D: 1.25≤Dv/Dn

<Average Dispersion Diameter>

Each toner (1 g) was immersed in chloroform (100 g) for 10 hours, and the toner dispersion liquid was centrifuged at 5,500 rpm (9,545 g) with a centrifuge (H-9R, product of KOKUSAN CO., LTD., using an angle rotor). The supernatant obtained after centrifugation was found to contain phenol multimer particles, which were measured for particle diameter with a particle size distribution analyzer (LA-920, product of Horiba, Ltd.). In the measurement using LA-920, LA-920 specialized application (Ver 3.32) (product of Horiba, Ltd.) was used for analysis.

TABLE 2

| | Q/M (Durability) | | Environmental stability | | | Granularity | |
|---|---|---|---|---|---|---|---|
| | Initial | Post-100 K | Normal temp., normal humidity | Low temp., low humidity | High temp., high humidity | Dv | Dv/Dn |
| Ex. 1 | A | A | A | B | B | A | A |
| Ex. 2 | A | A | A | B | B | A | A |
| Ex. 3 | A | A | A | B | B | A | A |
| Ex. 4 | A | A | A | A | A | A | A |
| Ex. 5 | A | A | A | A | A | A | A |
| Ex. 6 | A | A | A | A | A | A | A |
| Ex. 7 | B | B | B | B | B | A | A |
| Ex. 8 | B | B | B | B | B | A | A |
| Ex. 9 | B | B | B | B | B | A | A |
| Ex. 10 | B | B | B | B | B | A | A |
| Ex. 11 | B | B | B | B | B | A | A |
| Ex. 12 | B | B | B | B | B | A | A |
| Ex. 13 | B | B | B | B | B | A | A |
| Ex. 14 | B | B | B | B | B | A | A |
| Ex. 15 | C | C | C | C | D | A | A |
| Ex. 16 | C | C | C | C | D | A | A |
| Comp. Ex. 1 | C | C | C | C | D | D | D |
| Comp. Ex. 2 | — | — | — | — | — | D | D |

TABLE 3

| | | | Q/M (Durability) [μCg$^{-1}$] | | Environmental chrging stability [μCg$^{-1}$] | | |
|---|---|---|---|---|---|---|---|
| | Toner | Dispersion diameter (nm) | Initial | Post-100 K running | Normal temp., normal humidity | Low temp., low humidity | High temp., high humidity |
| Ex. 1 | a | 120 | −55.3 | −52.6 | −55.3 | −60.1 | −51.1 |
| Ex. 2 | b | 70 | −55.9 | −52.8 | −55.9 | −60.2 | −51.1 |
| Ex. 3 | c | 300 | −53.1 | −51.0 | −53.1 | −57.3 | −49.5 |
| Ex. 4 | d | 45 | −55.1 | −52.1 | −55.1 | −58.8 | −52.8 |
| Ex. 5 | e | 45 | −56.7 | −53.3 | −56.7 | −59.1 | −54.9 |
| Ex. 6 | f | 100 | −55.3 | −52.4 | −55.3 | −58.1 | −52.6 |

TABLE 3-continued

| | Toner | Dispersion diameter (nm) | Q/M (Durability) [μCg⁻¹] Initial | Post-100 K running | Environmental chrging stability [μCg⁻¹] Normal temp., normal humidity | Low temp., low humidity | High temp., high humidity |
|---|---|---|---|---|---|---|---|
| Ex. 7 | g | 40 | −44.8 | −41.1 | −44.8 | −47.6 | −40.1 |
| Ex. 8 | h | 37 | −47.3 | −43.4 | −47.3 | −52.3 | −42.4 |
| Ex. 9 | i | 31 | −46.6 | −41.6 | −46.6 | −51.1 | −41.9 |
| Ex. 10 | j | 44 | −45.5 | −41.5 | −45.5 | −50.1 | −40.8 |
| Ex. 11 | k | 42 | −46.2 | −42.2 | −46.2 | −51.2 | −42.1 |
| Ex. 12 | l | 39 | −48.4 | −46.6 | −48.4 | −52.8 | −53.7 |
| Ex. 13 | m | 46 | −60.2 | −58.1 | −60.2 | −64.6 | −55.4 |
| Ex. 14 | n | 55 | −70.2 | −68.6 | −70.2 | −75.1 | −65.2 |
| Ex. 15 | o | — | −25.1 | −21.4 | −25.1 | −29.4 | −21.2 |
| Ex. 16 | p | — | −26.5 | −22.1 | −26.5 | −31.4 | −21.8 |
| Comp. Ex. 1 | q | — | −21.5 | −18.7 | −21.5 | −30.1 | −12.4 |
| Comp. Ex. 2 | r | — | — | — | — | — | — |

As is clear from Tables 2 and 3, the toners of Examples 1 to 16 were excellent in granularity, durability and environmental stability. The phenol multimer used in toner o (Example 15) or toner p (Example 16) showed solubility to ethyl acetate and thus could not show sufficient charge-imparting effects when formed into a toner. Regarding durability, the toners of Examples 15 and 16 showed considerable spent on the carrier after 100,000-sheet running to greatly change in Q/M. Regarding environmental stability, the toners of Examples 15 and 16 was found to greatly change in Q/M after storage both under low-temperature, low-humidity environment and under high-temperature, high-humidity environment.

In contrast, toner q (Comparative Example 1) containing "TN-105," which has a structure of zirconium salicylate complex, is considerably poor in granularity and surface characteristics, although TN-105 exhibits high chargeability in a pulverized toner. Also, toner r (Comparative Example 2) containing "E-84," which has a structure of zinc salycilate complex structure, is considerably poor in granularity and cannot be formed into toner, although E-84 exhibits high charge-imparting effects in a pulverized toner. The toners of Comparative Examples 1 and 2 are inferior to those of Examples 1 to 16 in terms of durability, environmental stability and granularity.

This indicates that addition of the phenol multimer represented by General Formula (1) in the solution or dispersion liquid-preparing step can provide a toner excellent in chargeability, charge rising property, durability and environmental stability.

The embodiments of the present invention are as follows.

<1> A toner including:

a binder resin;

a colorant; and a phenol multimer represented by the following General Formula (1):

(1)

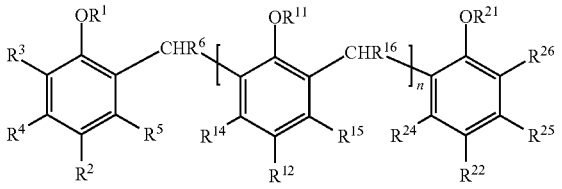

where $R^1$ represents a hydrogen atom, a C1-C5 alkyl group or $—(CH_2)_mCOOR^{10}$ where $R^{10}$ represents a hydrogen atom or a C1-C10 alkyl group and m is an integer of 1 to 3; $R^2$ represents a hydrogen atom, a halogen atom, a C1-C12 alkyl group which may be branched, an aralkyl group, $—NO_2$, $—NH_2$, $—SO_3H$, a phenyl group which may have a substituent, an alkoxy group, $—Si(CH_3)_3$ or $—NR^7{}_2$ where $R^7$ represents a C1-C10 alkyl group; $R^3$ to $R^5$ each represent a hydrogen atom, a halogen atom, a C1-C3 alkyl group, $—NH_2$ or $—N(R^9)_2$ where $R^9$ represents a C1-C10 alkyl group; $R^6$ represents a hydrogen atom or a C1-C3 alkyl group; $R^{11}$ represents a hydrogen atom, a C1-C5 alkyl group or $—(CH_2)_pCOOR^{20}$, where $R^{20}$ represents a hydrogen atom or a C1-C10 alkyl group and p is an integer of 1 to 3; $R^{12}$ represents a hydrogen atom, a halogen atom, a C1-C12 alkyl group which may be branched, an aralkyl group, $—NO_2$, $—NH_2$, $—N(R^{17})_2$, where $R^{17}$ represents a C1-C10 alkyl group, $—SO_3H$, a phenyl group which may have a substituent, an alkoxy group or $—Si(CH_3)_3$; $R^{14}$ and $R^{15}$ each represent a hydrogen atom, a halogen atom, a C1-C3 alkyl group, $—NH_2$ or $—N(R^{19})_2$ where $R^{19}$ represents a C1-C10 alkyl group; $R^{16}$ represents a hydrogen atom or a C1-C3 alkyl group; $R^{21}$ represents a hydrogen atom, a C1-C5 alkyl group or $—(CH_4COOR^{20}$, where $R^{20}$ represents a hydrogen atom or a C1-C10 alkyl group and q is an integer of 1 to 3; $R^{22}$ represents a hydrogen atom, a halogen atom, a C1-C12 alkyl group which may be branched, an aralkyl group, $—NO_2$, $—NH_2$ or $—N(R^{17})_2$, where $R^{17}$ represents a C1-C10 alkyl group, $—SO_3H$, a phenyl group which may have a substituent, an alkoxy group or $—Si(CH_3)_3$; $R^{24}$ and $R^{25}$ each represent a hydrogen atom, a halogen atom, a C1-C3 alkyl group, $—NH_2$ or $—N(R^{19})_2$, where $R^{19}$ represents a C1-C10 alkyl group; $R^{26}$ represents a hydrogen atom or a C1-C3 alkyl group; n denotes a polymerization degree which is an integer of 1 or greater.

<2> The toner according to <1>, wherein the toner is obtained by a toner production method including:

dissolving or dispersing in an organic solvent a toner material containing at least the phenol multimer and a binder resin or a binder resin precursor, to thereby prepare a solution or dispersion liquid of the toner material, adding the solution or dispersion liquid to an aqueous medium for emulsification or dispersion, to thereby prepare an emulsion or dispersion liquid, and removing the organic solvent from the emulsion or dispersion liquid.

<3> The toner according to <1> or <2>, wherein the phenol multimer is represented by the General Formula (1) where $R^1$, $R^{11}$, and $R^{21}$ each are a hydrogen atom, $R^2$, $R^{12}$, and $R^{22}$ each are a chlorine atom, $R^3$, $R^6$, $R^{16}$, and $R^{26}$ each are a hydrogen atom, and $R^4$, $R^5$, $R^{14}$, $R^{15}$, $R^{24}$, and $R^{25}$ each are a hydrogen atom or a methyl group.

<4> The toner according to any one of <1> to <3>, wherein the phenol multimer is represented by the General Formula (1) where $R^4$, $R^5$, $R^{14}$, $R^{15}$, $R^{24}$, and $R^{25}$ each are a hydrogen atom.

<5> The toner according to any one of <1> to <4>, wherein the phenol multimer is represented by the General Formula (1) where the polymerization degree denoted by n is 5 to 25.

<6> The toner according to any one of <1> to <5>, wherein the phenol multimer is represented by the General Formula (1) where $R^2$, $R^{12}$, and $R^{22}$ each are a chlorine atom, $R^1$, $R^3$ to $R^6$, $R^{11}$, $R^{14}$ to $R^{16}$, $R^{21}$, and $R^{24}$ to $R^{26}$ each are a hydrogen atom, and n is 7 to 19.

<7> The toner according to any one of <2> to <6>, wherein the aqueous medium contains anionic fine resin particles having an average particle diameter of 5 nm to 50 nm and an anionic surfactant.

<8> The toner according to any one of <1> to <7>, wherein the phenol multimer has chargeability.

<9> The toner according to any one of <1> to <8>, wherein the binder resin is a polyester resin.

<10> The toner according to any one of <1> to <9>, wherein an amount of the phenol multimer contained in the solution or dispersion liquid is 0.01% by mass to 5.0% by mass.

<11> The toner according to any one of <1> to <10>, wherein the phenol multimer contained in the solution or dispersion liquid of the toner material has an average dispersion diameter of 10 nm to 500 nm.

<12> The toner according to any one of <1> to <11>, wherein the charge amount of the toner is −80 μC/g to −10 μC/g.

<13> The toner according to any one of <1> to <12>, wherein the common logarithmic value Log ρ of the volume specific resistance ρ(Ωcm) of the toner is 10.9 Log Ωcm to 11.4 Log Ωcm.

<14> The toner according to any one of <1> to <13>, wherein a volume average particle diameter/a number average particle diameter (Dv/Dn) of the toner is 1.05 to 1.25.

<15> The toner according to any one of <1> to <14>, wherein the toner has an average circularity of 0.950 to 0.990.

<16> The toner according to any one of <1> to <15>, wherein the toner has a BET specific surface area of 0.5 $m^2/g$ to 4.0 $m^2/g$.

<17> The toner according to any one of <2> to <16>, wherein the toner material further contains an active hydrogen group-containing compound and a modified polyester resin reactive with the active hydrogen group-containing compound.

<18> A full-color image forming method including:

charging an electrophotographic photoconductor by a charging unit, exposing the electrophotographic photoconductor by an exposing unit, to thereby form a latent electrostatic image, developing the latent electrostatic image with the toner according to any one of <1> to <17>, to thereby form a toner image on the electrophotographic photoconductor, primarily transferring the toner image onto an intermediate transfer member by a primary transfer unit, secondarily transferring the toner image from the intermediate transfer member onto a recording medium by a secondary transfer unit, fixing the toner image on the recording medium, and cleaning the residual toner attached on a surface of the electrophotographic photoconductor from which the toner image has been transferred onto the intermediate transfer member by the primary transfer unit.

<19> The image forming method according to <18>, wherein the toner image is transferred onto the recording medium at a linear velocity of 300 mm/sec to 1,000 mm/sec, and the transfer time at a nip part of the secondary transfer unit is 0.5 msec to 20 msec.

<20> The image forming method according to <18> or <19>, wherein the full-color image forming method employs a tandem-type electrophotographic image forming process.

<21> A full-color image forming apparatus including:

an electrophotographic photoconductor, a charging unit configured to charge the electrophotographic photoconductor, an exposing unit configured to expose the electrophotographic photoconductor so as to form a latent electrostatic image on the electrophotographic photoconductor, a developing unit configured to develop with the toner according to any one of <1> to <17> the latent electrostatic image formed on the electrophotographic photoconductor so as to form a toner image, a transfer unit configured to transfer the toner image onto a recording medium directly or via an intermediate transfer member, a fixing unit configured to fix the toner image on the recording medium by a heat and pressure-applying member, and a cleaning unit configured to clean the residual toner attached on a surface of the electrophotographic photoconductor from which the toner image has been transferred onto the intermediate transfer member or the recording medium by the transfer unit.

INDUSTRIAL APPLICABILITY

The toner of the present invention is excellent in chargeability, durability and environmental stability in full-color image formation as well as has a small particle diameter. Thus, use of the toner of the present invention can stably provide high-quality images.

REFERENCE SIGNS LIST

1 Image forming apparatus
2 Process cartridge
3 Photoconductor
4 Exposing device
6 Image forming section
7 Automatic document feeder (ADF)
8 Scanner
801 Document table
802 Contact glass
803 Lamp
804 First carriage
805 Second carriage
806 Lens
807 CCD
9 Recording medium
10 Charging device
110 Roller-type charging device
111 Charging roller
112 Metal core
113 Electrically conductive rubber layer
114 Power source
120 Fur brush charging device
121 Brush roller

122 Metal core
123 Brush part
124 Power source
130 Magnetic brush charging device
131 Brush roller
133 Brush part
134 Power source
20 Cleaning device
21 Cleaning blade
40 Developing device
41 Developing sleeve
42 Regulating member
43, 44 Stirring/conveying screw
46 Power source
47 Developing region
48 Transfer tube
50 Transfer device
51 Intermediate transfer belt
52 Primary transfer device
521 Primary transfer roller
523, 524, 525 Electrically conductive roller
53 Support roller
531 Drive roller
532 Second transfer counter roller
533 Support roller
54 Secondary transfer device
541 Secondary transfer roller
55 Belt cleaning device
551 Electrically conductive fur brush
552 Electrically conductive fur brush
56 Pre-transfer charger
60 Paper feeding device
61 Paper feeding cassette
62 Paper feeding roller
63 Transfer roller
64 Registration roller
65 Transfer belt
651, 652 Support roller
66 Separation roller
67 Sheet inversion device
70 Fixing device
710 Heating roller
720 Fixing roller (counter rotator)
721 Metal core
722 Elastic member
730 Fixing belt (heat-resistant belt, toner heating medium)
731 Substrate
732 Heat generation layer
733 Intermediate layer
734 Release layer
740 Press roller (press rotator)
741 Metal core
742 Elastic member
750 Temperature detecting member
760 Induction heating unit
761 Exciting coil
762 Coil guide plate
763 Exciting coil core
764 Exciting coil core supporting member
770 Recording medium
90 Discharge device
91 Discharge tray
93 Discharge roller
100 Toner
101 Toner base particles
102 External additive

The invention claimed is:

1. A toner, comprising:
a binder resin;
a colorant; and
a phenol multimer represented by Formula (1):

(1)

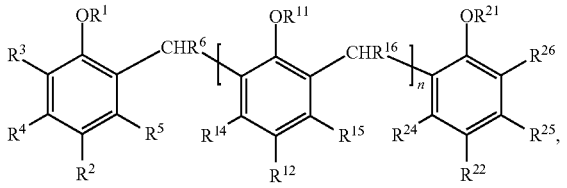

where $R^1$, $R^{11}$, and $R^{21}$ each are a hydrogen atom;
$R^2$, $R^{12}$, and $R^{22}$ each are a chlorine atom;
$R^3$, $R^6$, $R^{16}$, and $R^{26}$ each are a hydrogen atom; and
$R^4$, $R^5$, $R^{14}$, $R^{15}$, $R^{24}$, and $R^{25}$ each are a hydrogen atom or a methyl group; and
n denotes a polymerization degree which is an integer of 1 or greater.

2. The toner according to claim 1,
wherein the phenol multimer is represented by the Formula (1),
where $R^4$, $R^5$, $R^{14}$, $R^{15}$, $R^{24}$, and $R^{25}$ each are a hydrogen atom.

3. The toner according to claim 1,
wherein the phenol multimer is represented by the Formula (1),
where n is from 5 to 25.

4. The toner according to claim 1,
wherein the phenol multimer is represented by the Formula (1),
where $R^2$, $R^{12}$, and $R^{22}$ each are a chlorine atom;
$R^1$, $R^3$ to $R^6$, $R^{11}$, $R^{14}$ to $R^{16}$, $R^{21}$, and $R^{24}$ to $R^{26}$ each are a hydrogen atom; and
n is from 7 to 19.

5. The toner according to claim 1,
wherein the phenol multimer has chargeability.

6. The toner according to claim 1,
wherein the binder resin is a polyester resin.

7. The toner according to claim 1,
wherein the phenol multimer comprises the toner in an amount of from 0.01% by mass to 5.0% by mass.

8. The toner according to claim 1,
wherein a charge amount of the toner is from −80 μC/g to −10 μC/g.

9. The toner according to claim 1,
wherein a common logarithmic value Log ρ of a volume specific resistance ρ of the toner is from 10.9 Log Ωcm to 11.4 Log Ωcm.

10. The toner according to claim 1,
wherein a ratio of a volume average particle diameter to a number average particle diameter of the toner is from 1.05 to 1.25.

11. The toner according to claim 1,
wherein the toner has an average circularity of from 0.950 to 0.990.

12. The toner according to claim 1,
wherein the toner has a BET specific surface area of from 0.5 $m^2/g$ to 4.0 $m^2/g$.

* * * * *